US005271140A

United States Patent [19]

Futamura et al.

[11] Patent Number: 5,271,140

[45] Date of Patent: Dec. 21, 1993

[54] INDEX-FEED MACHINING SYSTEM

[75] Inventors: Shoji Futamura, Kawasaki; Kazuo Igarashi, Yokohama, both of Japan

[73] Assignee: Institute of Technology Precision Electrical Discharge Work's, Kanagawa, Japan

[21] Appl. No.: 697,602

[22] Filed: May 8, 1991

[30] Foreign Application Priority Data

May 11, 1990 [JP] Japan ..... 2-121758
May 11, 1990 [JP] Japan ..... 2-121759
May 11, 1990 [JP] Japan ..... 2-121760
May 11, 1990 [JP] Japan ..... 2-121761

[51] Int. Cl.[5] ..... B26D 1/03; B26F 1/04

[52] U.S. Cl. ..... 29/33 K; 29/33 Q; 29/335; 29/564.2; 29/758; 29/793; 72/442; 83/255

[58] Field of Search ..... 29/33 K, 33 R, 33 S, 29/564.1, 564.2, 771, 786, 788, 793, 796; 72/404, 442, 446, 449; 83/55, 255, 516

[56] References Cited

U.S. PATENT DOCUMENTS 2,283,629 5/1942 Hetfler ..... 83/255 X
2,754,877 7/1956 Gasstsom ..... 29/33 K
3,292,412 12/1966 Costabile ..... 72/404 X
3,315,331 4/1967 Weiss ..... 29/564.1 X
3,673,908 7/1972 Smith ..... 72/446 X
3,982,457 9/1976 Berry ..... 83/516
4,285,754 8/1981 DiMatteo ..... 83/55 X
4,615,207 10/1986 Oboshi et al. ..... 72/404
5,036,574 8/1991 Kakimoto ..... 29/335

FOREIGN PATENT DOCUMENTS 0008343 4/1912 United Kingdom ..... 29/33 K
1557031 12/1979 United Kingdom ..... 72/446

*Primary Examiner*—Z. R. Bilinsky
*Attorney, Agent, or Firm*—McGlew and Tuttle

[57] ABSTRACT

An index-feed machining system having a pilot machining device for sequentially forming pilot portions on a workpiece indexed at predetermined pitches, a pilot guide means engaging with the pilot portions, and a plurality of independent machining means corresponding to a plurality of machining processes; all of these means being sequentially disposed in the feeding direction of workpiece; in which the pilot machining means and the pilot guide means are constructed integrally. The index-feed machining system lends itself to the easy positioning of machining means, and to the manufacture of high-precision products.

10 Claims, 28 Drawing Sheets

INDEX-FEED MACHINING SYSTEM

BACKGROUND OF THE INVENTION

This invention relates generally to an index-feed machining system, and more particularly to an index-feed machining system having a plurality of machining means for sequentially performing a plurality of machining processes, such as punching, bending and drawing, on a strip-shaped workpiece indexed at predetermined pitches, adapted to improve the accuracy of machining positions in each aforementioned machining process.

DESCRIPTION OF THE PRIOR ART

An index-feed machining system for manufacturing sheet-metal products of a predetermined shape by continuously carrying out a plurality of machining processes, such as punching, bending, drawing and compression, on a metal strip indexed at predetermined indexing pitches is heretofore known.

FIG. 1 is a diagram of assistance in explaining an index-feed machining system of a conventional type for manufacturing a cup-shaped sheet-metal product. In FIG. 1, the system is shown cross-sectionally and rather schematically with hatching omitted for ease of understanding.

In FIG. 1, reference numeral 10 refers to a block die consisting of an upper die 10*a* and a lower die 10*b*; the upper die 10*a* being fitted to a press ram (not shown) via a shank 11, and the lower die 10*b* being fitted to a positioning clamp plate (not shown) on a press table. On the block die 10 disposed are a piercing punch 12*a* and piercing die 12*b*, a lancing punch 13*a* and a lancing die 13*b*, first through fourth drawing dies 14*a* through 17*a* and first through fourth drawing punches 14*b* through 17*b*, first and second shaping dies 18*a* and 19*a* and first and second shaping punches 18*b* and 19*b*, and a trimming die 20*a* and a trimming punch 20*b*, from the left to the right in the figure. These punches and dies are each held by the upper die holder 21*a* and the lower die holder 21*b* at predetermined spacings.

With the aforementioned construction, when a workpiece, such as a steel strip, is indexed from the left in between the punches and dies at equal pitches, the workpiece is subjected sequentially to punching, bending, and drawing operations with the aforementioned punches and dies to form cup-shaped or cap-shaped sheet-metal products.

FIGS. 2 and 3 are a plan view and a front view illustrating the machining state of the workpiece. In both figures, as a workpiece 30 is indexed from the left to the right at equal pitches P, pilot holes 40 are provided with a piercing punch 12*a* and a piercing die 12*b*, as shown in FIG. 1. The workpiece 30 is positioned at each machining stage by engaging the pilot holes 40 with pilot guides (not shown) disposed between the upper and lower die holders 21*a* and 21*b*. Next, 31–38 are numerals indicating machining stages spaced with intervals equal to an indexing pitch P of the workpiece 30. These stages will be outlined, referring to both figures, and FIG. 1 as well.

At Stage 31, an arc-shaped lance having a diameter larger than the external diameter of a cap-shaped sheet-metal product is first provided on the workpiece 30 with the lancing punch 13*a* and the lancing die 13*b*. The workpiece 30 is thereafter indexed rightwards at pitches P, thereby being subjected to first through fourth drawing operations with the first through fourth drawing dies 14*a* through 17*a* and punches 14*b* through 17*b* at Stages 32–35. Upon completion of the above-mentioned lancing and drawing operations, the workpiece 30 is subjected to first and second shaping operations with the first and second shaping dies 18*a* and 19*a* and punches 18*b* and 19*b* at Stages 36 and 37 to complete internal and external machining operations. Next, the external dimensions of the finished product is finally shaped with the trimming die 20*a* and punch 20*b* at Stage 38, and then the finished cap-shaped sheet-metal products 39 is separated from the workpiece to complete the entire machining process. Each of Stages 31 through 38 has on the block die 10 a wrinkle preventing means (not shown) for preventing wrinkles from generating on the workpiece 30 during drawing and shaping operations, and a knock-out means (not shown).

Although the aforementioned index-feed machining system has a number of advantages, including high production rate, and the suitability for high-voltage production of sheet-metal products having a predetermined shape, it has the following disadvantages. That is, having multiple pairs of punches and dies in a single unit, the conventional metal mold tends to have a very complicated construction requiring high-precision mold manufacturing technology, long manufacturing time and high manufacturing cost as well. In addition, when repairing partial damages to the mold, or adjusting the mold, the entire mold has to be disassembled, requiring considerable time and labor. Furthermore, when the conventional metal mold is used for short production runs in which multiple types of products are manufactured in limited quantities, different molds dedicated for different shapes of products have to be manufactured. This leads to increased mold costs, and makes it difficult to adapt the conventional index-feed machining system to the so-called advanced FMS production system that has been increasingly demanded in recent years.

The present Applicant and others proposed in Japanese Patent Application No. 304694/1988, filed on Dec. 1, 1988, an index-feed machining system, as shown in FIGS. 4 and 5, that has such a simple construction that partial adjustment can be made easily, and can solve problems inherent in the prior art. FIG. 4 is a front view of the essential part of the previously proposed index-feed machining system, and FIG. 5 is a plan view of the same.

In the previously proposed index-feed machining system, a pilot machining means 50 for machining pilot holes is set on a press table 23 using two T grooves 22 provided on the press table 23, as shown in FIGS. 4 and 5. A pilot guide means 60 for adjusting the machining position of a workpiece is then set by engaging with the pilot hole at a distance P from the pilot machining means 50. The distance P is an indexing pitch of the workpiece (not shown) that is fed leftwards from the right. Furthermore, a first machining means 70 is disposed at a distance of 2.5P from the pilot machining means 50, a second machining means 80 at a distance of 4.5P, another unit of the pilot guide means 60 at a distance of 6P, a third machining means 90 at a distance of 7.5P, and a fourth machining means 100 at a distance of 9.5P. Reference numeral 24 indicates a mounting bolt; and 25 a spacer. The spacers 25 are disposed on the underside of the press ram 26 at positions corresponding to the positions of the pilot machining means 50 through the fourth machining means 100.

By indexing a steel strip, for example, from the right at equal pitches and causing the press ram 26 to operate, the index-feed machining system having the aforementioned construction can produce cup-shaped or cap-shaped sheet-metal products, as shown in FIG. 7, through machining processes as shown in FIG. 6, which will be described later.

FIG. 6 is a plan view illustrating the state of machining the workpiece, and FIGS. 7 through 9 are diagram illustrating the longitudinal sectional shape of the workpiece at each stage in FIG. 6, shown in the same positional relationship with FIGS. 4 and 5 for clarity.

In FIGS. 4 through 9, a workpiece 30 is fed leftwards from the right at equal pitches, and pilot holes 40 are provided with a pilot machining means 50. As the workpiece 30 is then moved by an indexing-pitch feed P, the next pilot holes 40 are provided, and pilot pins (not shown) of a pilot guide means 60 are engaged with the previously provided pilot holes 40 to effect positioning of the workpiece 30. As a result, some errors in indexing-pitch feed, if caused, can be corrected with the pilot guide means 60. As the workpiece 30 is further moved by another indexing-pitch feed P, Stage 41 begins, in which arc-shaped lancings 70*a* are machined with a first machining means 70. Then, after skipping an idle stage 42, the workpiece 30 reaches Stage 43 in which the workpiece 30 is drawn with a second machining means 80 to form a cup-shaped projection 80*a* on the workpiece 30, as shown in FIG. 7, and the arc-shaped lancings 70*a* are formed into arc-shaped grooves 70*b* by expanding the width thereof. The workpiece 30 then reaches Stage 46 while skipping idle stages 44 and 45, flange holes 90*a* (shown in FIG. 8) are machined with a third machining means 90. Furthermore, as the workpiece 30 skips an idle stage 47 and reaches Stages 48, trimming is effected along the external dimensions of a cup-shaped sheet-metal product 100*a* (shown in FIG. 9) with a fourth machining means 100. Thus, machining operations are completed.

The previously proposed index-feed machining system, as described in the foregoing, is designed to improve the means for disposing a plurality of independent machining means disposed on the base plate, and improve working efficiency in changing and moving the machining means to meet the need for changing the types of machining, processes and machining sequence. In order to improve the accuracy of products, a pilot machining means 50 and a pilot guide means 60 are provided to improve the accuracy of machining positions with respect to the workpiece 30 at each stage. However, the accuracy of the machining position of each machining means can be improved only when the mounting position of the pilot guide means for correcting machining positions, not to speak of the mounting position of each machining means, is accurately set corresponding to the indexing pitch P of the workpiece 30.

If the distance between the pilot machining means 50 and the pilot guide means 60 is ($P \pm \delta$) with respect to the indexing pitch P of the workpiece 30, however, the difference of $\delta$ might accumulate at every indexing-pitch feed, leading to a great error. The mechanism of generating such a great error is described in more detail, referring to FIGS. 10 and 11. The distance between the pilot machining means 50 and the pilot guide means 60 may not necessarily agree with the indexing-pitch feed P, and may sometimes be nP (n being a positive integer) in accordance with the size of a finished product. FIGS. 10 and 11 show the state where an error occurs when the distance between the pilot machining means 50 and the pilot guide means 60, which is to be 3P, is set by mistake at 3.1P. (A) represents the position at which the pilot machining means 50 is installed, and (B) the position at which the pilot guide means 60 is installed. FIG. 10 shows the state where the indexing-pitch feed of the workpiece 30 is accurately set at P, while FIG. 11 shows the state where the indexing-pitch feed of the workpiece 30 has some error.

In FIG. 10, a first pilot hole ① is punched at time $T_1$, the workpiece 30 is moved by an indexing-pitch feed during a period from time $T_1$ to $T_2$, and a second pilot hole ② is punched at time $T_2$. Furthermore, the workpiece is moved by an indexing-pitch feed during a period from $T_2$ to $T_3$ and a third pilot hole ③ is punched at time $T_3$. Since the indexing-pitch feed during the period is accurately set at 1P, the distances between the pilot holes ①-② and between the pilot holes ②-③ are 1P, respectively. Next, the workpiece is moved by an indexing-pitch feed during period from time $T_3$ to $T_4$, pilot guidance is performed on the pilot hole ① with the pilot guide means 60, and then a fourth pilot hole ④ is punched at time $T_4$. Since the indexing-pitch feed effected during the period from $T_3$ to $T_4$ substantially becomes 1.1P because the distance between the pilot machining means 50 and the pilot guide means 60 is 3.1P, thus, the distance between the pilot holes ③ and ④ is 1.1P. Similarly, pilot holes ⑤ and ⑥,—are punched every time the workpiece is moved by an indexing-pitch feed, and pilot guidance is performed at every three indexing-pitch feeds.

As is evident from FIG. 10, since the distance between the pilot machining means 50 and the pilot guide means 60, which is to be 3P, has been set at 3.1P, the difference of 0.1P is added up at every three indexing-pitch feeds, and thereby the error is accumulated to an even larger value.

The example shown in FIG. 11 is essentially the same as that shown in FIG. 10 in that the distance between the pilot machining means 50 and the pilot guide means 60 has been set at 3.1P, instead of 3P, the difference of 0.1P is added up at every three indexing-pitch feeds, and thereby the error is further aggravated. In the example shown in FIG. 11, the indexing feed P has an error. As a result, the indexing feed effected during the period from time $T_1$ to $T_2$ is 1.2P, and the indexing feed effected during the period from $T_2$ to $T_3$ is 0.9P.

As described above, it is essential to accurately maintain the distance between the pilot machining means and the pilot guide means in order to improve the accuracy of finished products machined with the index-feed machining system. It is also desired to improve the accuracy of positioning other machining means.

In the previously proposed index-feed machining system described with reference to FIGS. 4 and 5, U-shaped pilot guides 60 are provided to accurately position machining positions with respect to the workpiece. This arrangement, however, involves an unwanted problem of lowering the indexing accuracy of the machining position at Stage 43 because the workpiece tends to be subjected to expansion and shrinkage during machining at each stage, and as a result, the portion machined at Stage 41 in FIG. 6, for example, is fed to Stage 43.

In order to improve the accuracy of machining positions, various means can be considered, including installation of an additional U-shaped pilot guide 60 between the U-shaped punch die sets 70 and 80 shown in FIG. 4, or increasing the number of the U-shaped pilot guides 60. Increasing the number of additional U-shaped pilot guides 60, however, will result in a further increase in the line length of the index-feed machining system, which otherwise tends to be increased by the presence of the existing U-shaped pilot guides 60.

Not only the previously proposed index-feed machining system but also ordinary index-feed machining systems are manufactured as so-called special-purpose index-feed machining systems in which a press ram driving means comprising hydraulic equipment, etc. is installed. This tends to increase manufacturing costs, leading to expensive equipment.

This invention is intended to overcome the aforementioned problems since an index-feed machining system is easily constructed by using known press machines, such as press brakes. That is, an index-feed machining system can be easily constructed by disposing machining means, such as punch-die sets 50 through 100 shown in FIG. 4, on the machining base of a press brake. In this case, a press ram 26 shown in FIG. 4 corresponds to a ram of a press brake.

In an index-feed machining system using a press brake, if the working stroke or the position of the bottom dead point of a punch in each punch-die set is different from that in other punch-die set, the stroke or the bottom dead point must be adjusted by changing the height of the spacer 25. Consequently, if a punch-die set has to be changed to cope with changes in machining processes, not only a punch-die set must be changed, but also spacers 25 must be changed to adjust for the working stroke and the bottom dead point of the punch in that punch-die set. This poses an unwanted problem of providing spare spacers for different punch-die sets.

Furthermore, though capable of efficiently and continuously machining a strip-shaped workpiece into sheet-metal products, the aforementioned index-feed machining system, which involves the feeding of workpiece in a single direction, cannot be applied to the assembly of multiple components. That is, components individually machined with a plurality of index-feed machining systems have to be assembled on assembly equipment. This makes it difficult to achieve efficient production due partly to a large number of components-in-process involved, and partly to much time and labor required for handling, storage, assorting, transportation, etc. of components. In addition, if components are fed manually to the assembly equipment, the dimensional accuracy of assembled products cannot be kept at a high level due to complicated operations and accumulated positional errors. Working efficiency can be improved by automating the feeding of components, or introducing industrial robots. But this leads to increased equipment cost, and could lower the operating rate of the entire system when multiple types of assembled products are produced in relatively small quantities.

SUMMARY OF THE INVENTION

It is the first object of this invention to provide an index-feed machining system that can accurately maintain the distance between the pilot machining means and the pilot guide means, can improve the accuracy of machining positions with respect to a workpiece at each machining stage by improving the positioning accuracy of other machining means, and can manufacture high-quality products.

It is the second object of this invention to provide an index-feed machining system of a simple construction that can easily perform partial adjustment.

It is the third object of this invention to provide an index-feed machining system that is based on the aforementioned previously proposed index-feed machining system, in which working efficiency in relation to the exchange and movement of machining means associated with changes in machining operations, machining processes and machining sequence is improved by improving a means for disposing a plurality of independent machining means disposed on the base plate is improved.

It is the fourth object of this invention to provide an index-feed machining system, in which the accuracy of machining position with respect to the workpiece is improved by disposing pilot guides close to machining positions without increasing the line length of the index-feed machining system, and making it possible to easily adjust the mounting positions of the pilot guides.

It is the fifth object of this invention to provide an index-feed machining system having a multi-line construction that can automate all necessary operations up to the assembly operation of an assembled products consisting of a plurality of members.

BRIEF DESCRIPTION OF THE DRAWINGS

FIG. 23 is an enlarged perspective view of component members shown in FIGS. 21 and 22.

DETAILED DESCRIPTION OF THE EMBODIMENTS

Figure 12:
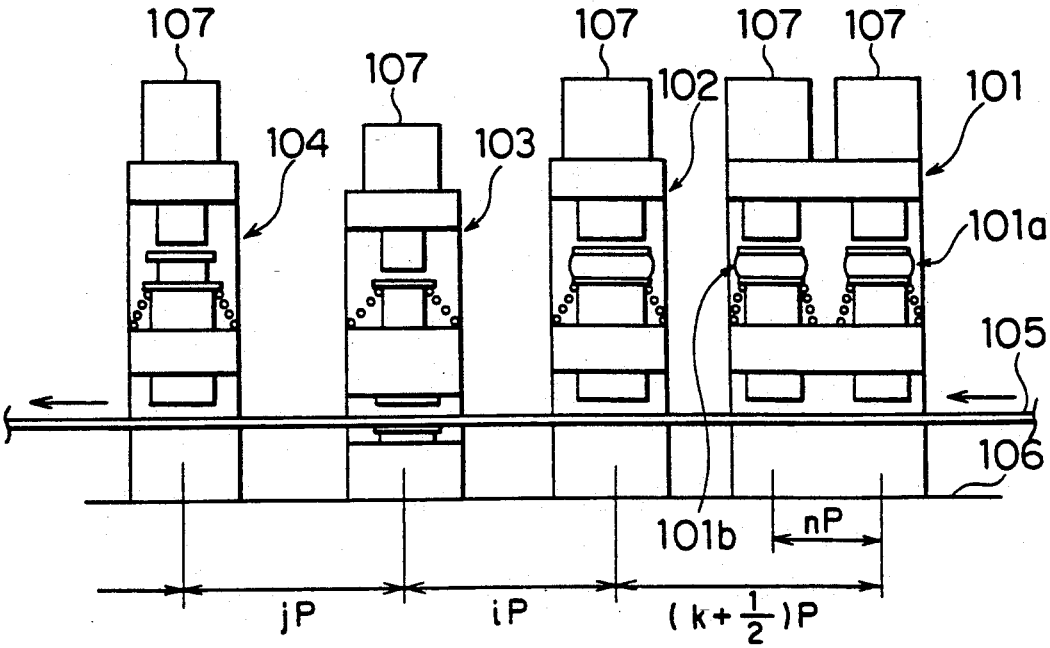
FIG. 12 is a front view of the essential part of a first embodiment of this invention to explain the basic concept of the embodiment.

FIG. 12 is a front view of the essential part of a first embodiment of this invention illustrating the basic concept thereof.

In FIG. 12, reference numeral 101 refers to a pilot means, constructed integrally of a pilot machining means 101*a* and a pilot guide means 101*b*; 102 through 104 to machining means; 105 to a workpiece; 106 to a press table; 107 to a driving means, respectively.

In the index-feed machining system according to this invention, the pilot means 101 for improving the accuracy of machining positions when machining with machining means 102 through 104 is constructed integrally of the pilot machining means 101*a* for punching pilot holes, which will be described later, and a pilot guide means 101*b* having pilot pins (not shown) for engaging with the pilot holes as a workpiece 105 is moved by an indexing-pitch feed, as shown in FIG. 12. Both the pilot holes provided by the pilot machining means 101*a* and the pilot pins in the pilot guide means 101*b* are usually provided at intervals of nP (n being a positive integer, P being the distance to which the workpiece 105 is fed at an indexing pitch). Consequently, the pilot holes provided with the pilot machining means 101*a* and the pilot pins (not shown) in the pilot guide means 101*b* are always kept at intervals of nP without separately setting the positions of the pilot machining means 101*a* and the pilot guide means 101*b*. The pilot machining means 101*a*, the pilot guide means 101*b* and the machining means 102 through 104 have their respective independent driving means 107. The driving means 107 comprises a hydraulic cylinder, for example, and is driven independently with a hydraulic control device, such as a solenoid valve (not shown).

Figure 1:
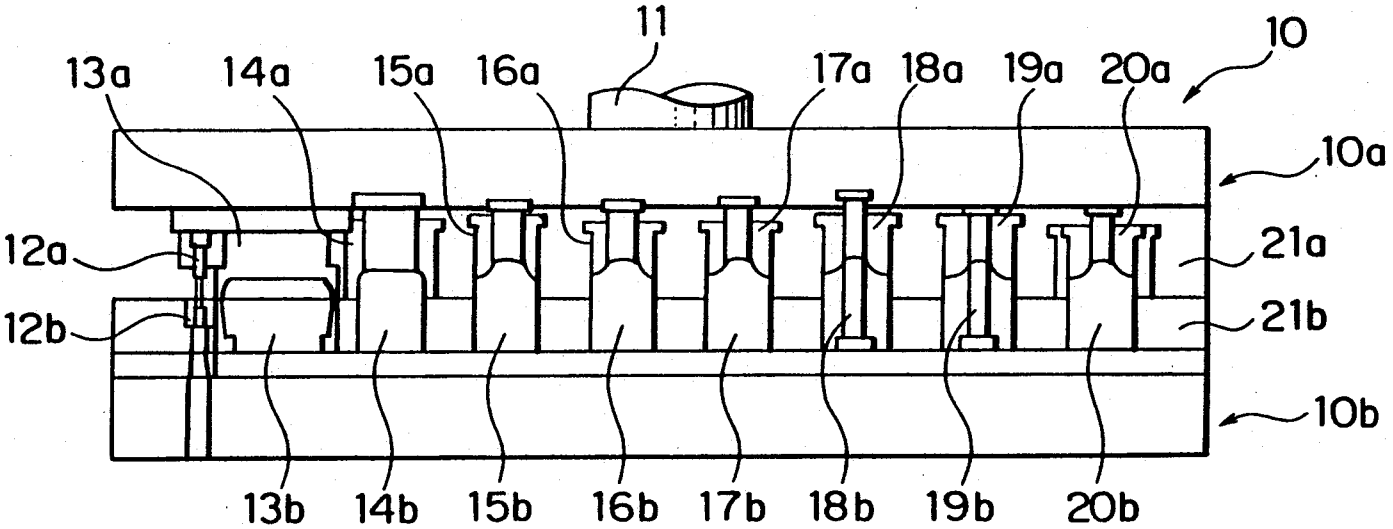
FIG. 1 (PRIOR ART)
FIG. 1 is a diagram of assistance in explaining an example of a conventional index-feed machining system.
Figure 2:
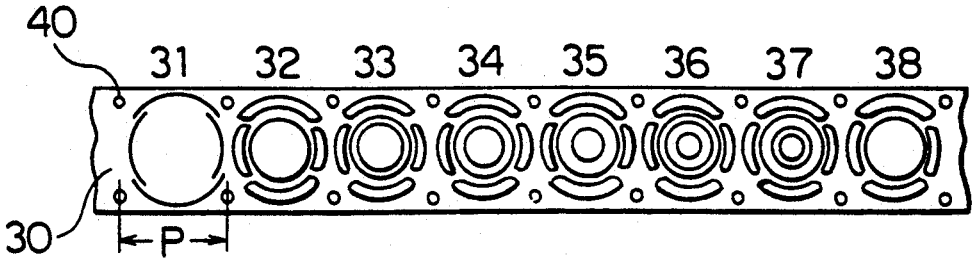
FIG. 2 (PRIOR ART)
FIGS. 2 and 3 are a plan view and a front view illustrating the state where a workpiece is machined.
Figure 3:
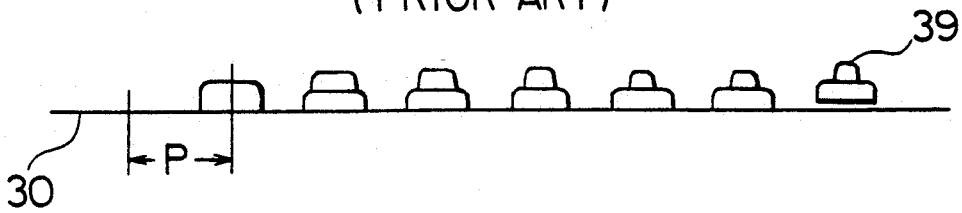
FIG. 3 (PRIOR ART)
Figure 4:
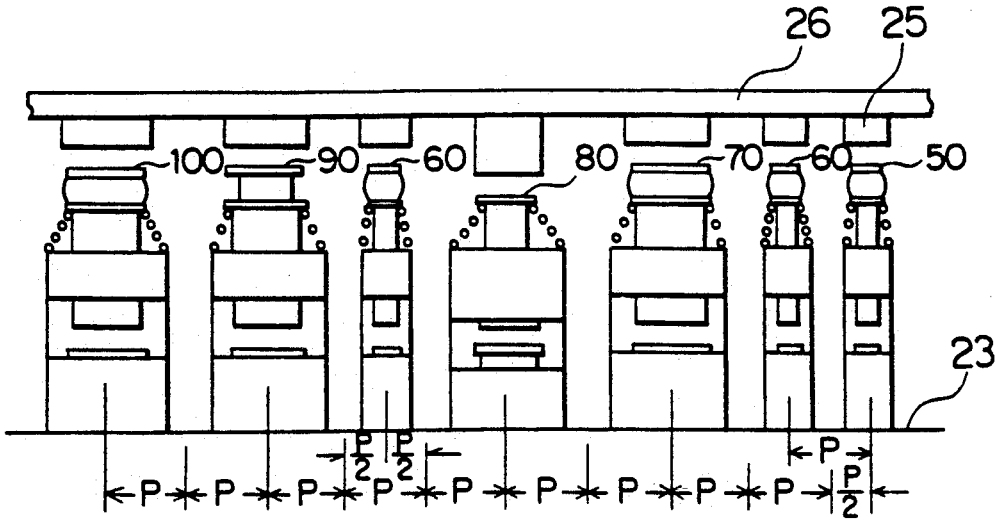
FIG. 4 (PRIOR ART)
FIGS. 4 and 5 are a front view and a plan view of the essential part of an index-feed machining system on which this invention is based.
Figure 5:
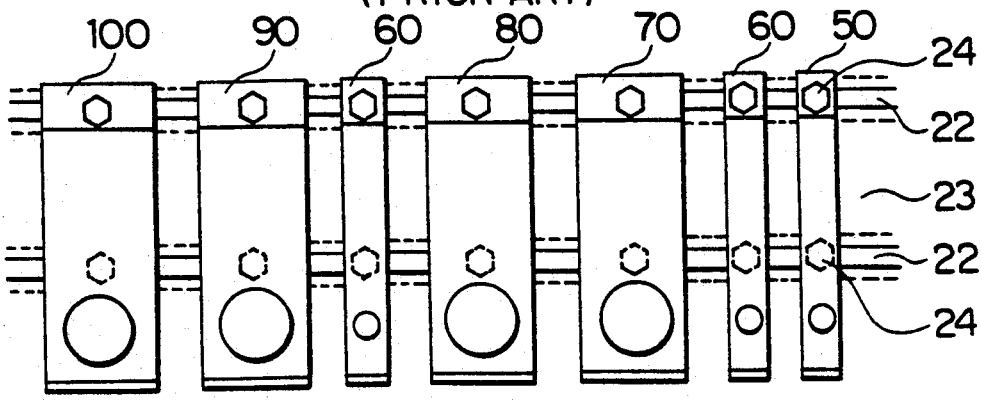
FIG. 5 (PRIOR ART)
Figure 6:
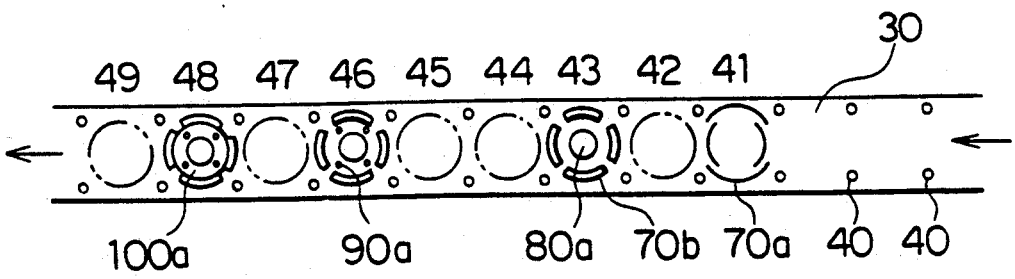
FIG. 6 (PRIOR ART)
FIG. 6 is a plan view illustrating the state where a workpiece is machined with the index-feed machining system shown in FIGS. 4 and 5.
Figure 9:
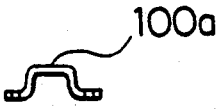
FIG. 9 (PRIOR ART)
FIGS. 7 through 9 are cross-sections of the essential part of the workpiece shown in FIG. 6.
Figure 7:
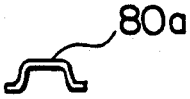
FIG. 7 (PRIOR ART)
Figure 8:
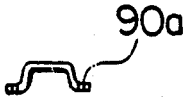
FIG. 8 (PRIOR ART)
Figure 10:
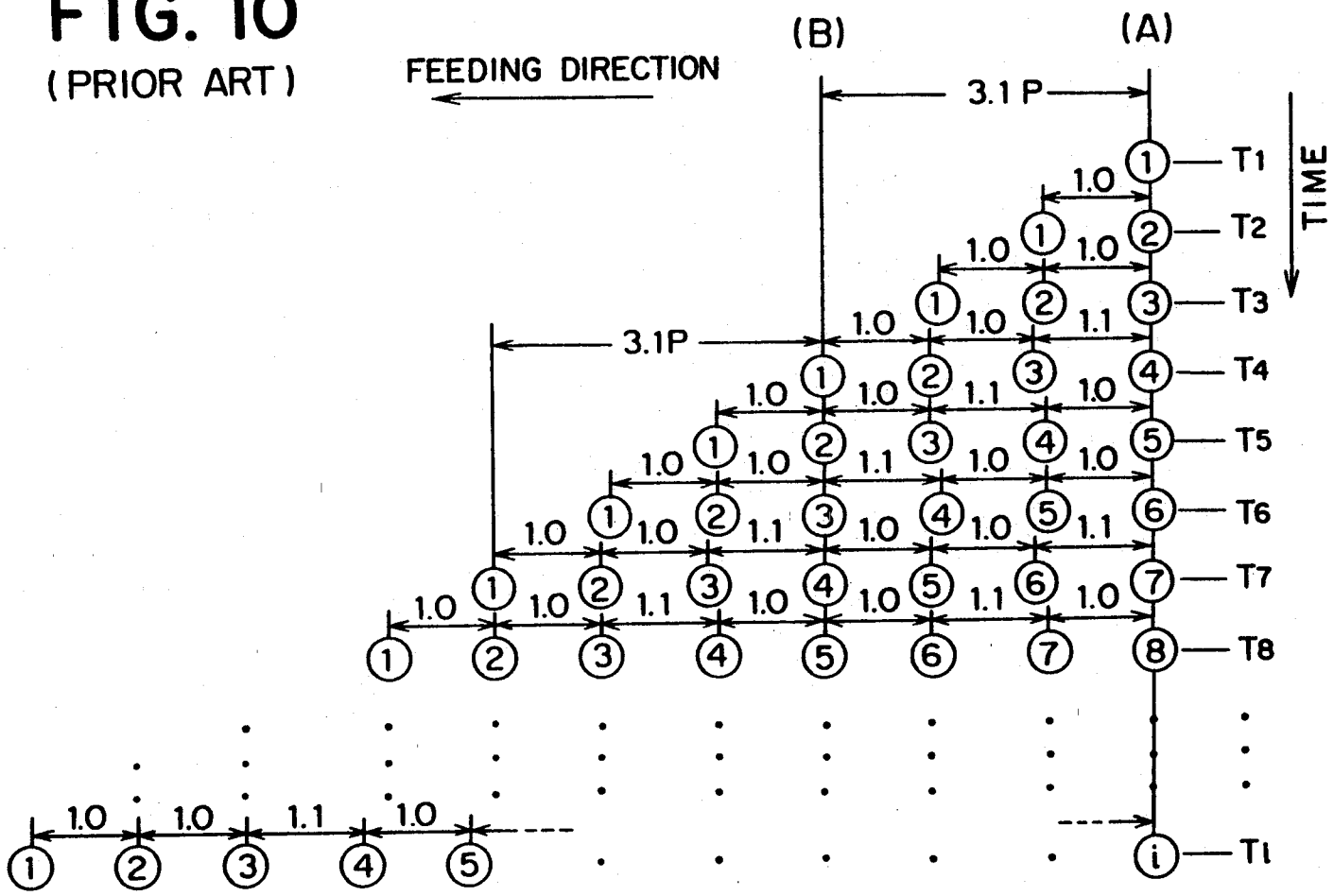
FIG. 10 (PRIOR ART)
FIGS. 10 and 11 are diagram of assistance in explaining problems caused in relation to errors in the mounting locations of pilot guides.
Figure 11:
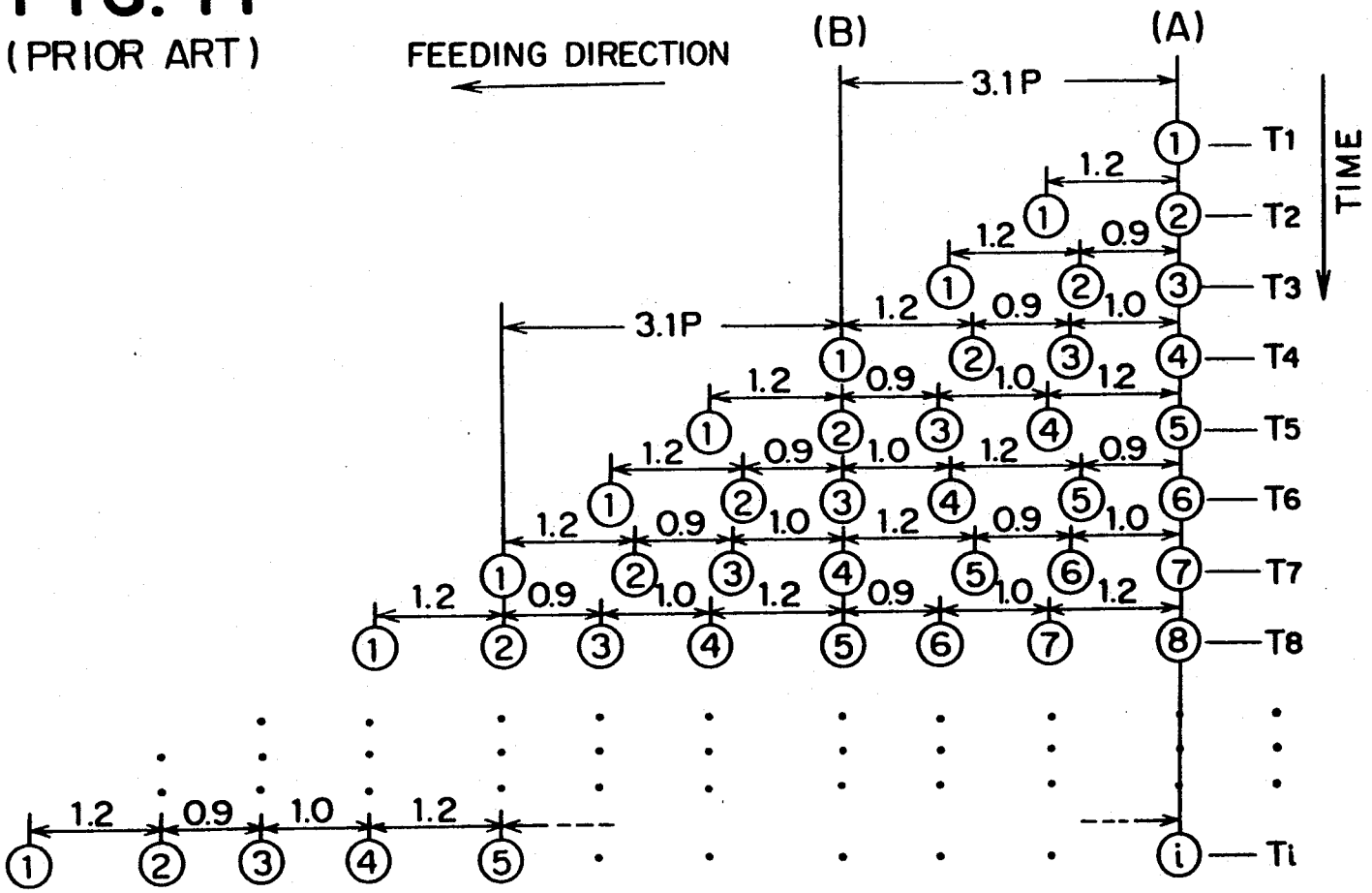
FIG. 11 (PRIOR ART)

The machining means 102 through 104 corresponding to the machining process of index-feed machining are disposed sequentially on the press table 106 in a machining order. The pilot means 101 and the machining means 102 through 104 are installed using two T grooves (not shown) provided on the press table 106, as in the case with the index-feed machining system shown in FIGS. 4 and 5, described in the begining of this Specification.

The machining means 102 through 104 are installed as follows. That is, the first machining means 102 is installed at a position $(k+\frac{1}{2})P$ away from the position of the pilot machining means 101*a*, the second machining means 103 at a position iP from the position of the first machining means 102, and the third machining means 104 at a position jP from the position of the second machining means 103. Symbols k, i and j represent positive integers.

In the index-feed machining system of this invention described above, the indexing feed of the workpiece 105 can be corrected at least at every n indexing-pitch feeds of the workpiece 105, and thereby the accuracy of machining positions when machining with the machining means 102 through 104 since the pilot machining means 101*a* and the pilot guide means 101*b* are constructed integrally.

Figure 13:
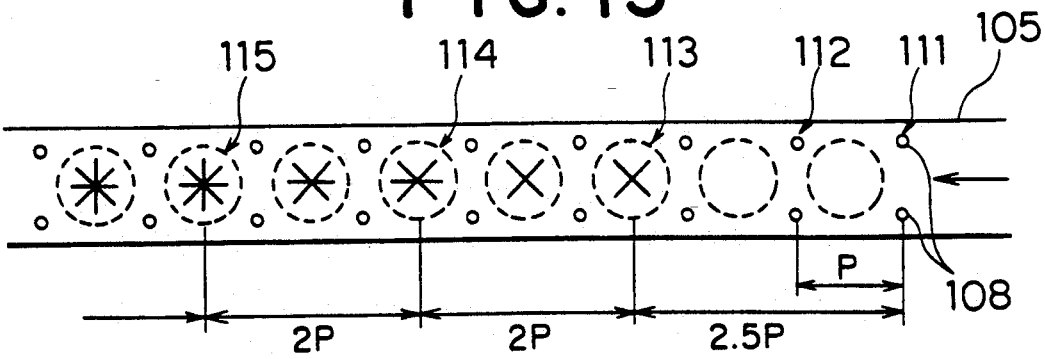
FIGS. 13 and 14 are diagrams of assistance in explaining an example of machining operations in the first embodiment of this invention.

FIG. 13 is a diagram of assistance in explaining an example of machining in the first embodiment of this invention. In the figure, relative positions of components are shown in the same positional relationship with FIG. 12 for clarity, and circles shown by dotted lines indicate machining positions.

FIG. 13 shows the state where the workpiece 105 is machined with $n=1$, $k=i=j=2$ in the embodiment shown in FIG. 12. That is, one indexing-pitch feed P of the workpiece 105 is set to equal to the distance between the positions of the pilot holes 108 provided by the pilot machining means 101*a* and the positions of the pilot pins (not shown) of the pilot guide means 101b, while the first machining means 102 is installed at a position 2.5P away from the position of the pilot machining means 101a, the second machining means 103 at a position 2P away from the position of the first machining means 102, and the third machining means 104 at a position 2P away from the position of the second machining means 103.

In FIG. 13, pilot holes 108, 108 are first punched with the pilot machining means 101a at positions shown by arrow 111 in the figure. After that, as the workpiece 105 is moved by an indexing-pitch feed, the pilot pins are engaged by the pilot guide means 101b with the pilot holes 108, 108 at positions shown by arrow 112.

In this way, the pilot holes 108, 108 are punched sequentially as the workpiece 105 is moved by an indexing-pitch feed. Consequently, even if there are some errors in indexing-pitch feed, the distance P between the sequentially punched pilot holes is kept constant. As a result, the first machining position 113 machined by the first machining means 102, the second machining position 114 machined by the second machining means 103, the third machining position 115 machined by the third machining means 104,—are positioned accurately, and thereby products can be manufactured at high precision. Symbols X, ✱ , * schematically indicate the state of machining with the machining means 102 through 104.

Although the state of machining described above, referring to FIG. 13, is applied to products of relatively large sizes, if the state of machining shown in FIG. 13 is applied to products of smaller sizes, the yield of the workpiece 105 would be lowered. An example of machining operation to be applied to small products will be described with reference to FIG. 14.

Figure 14:
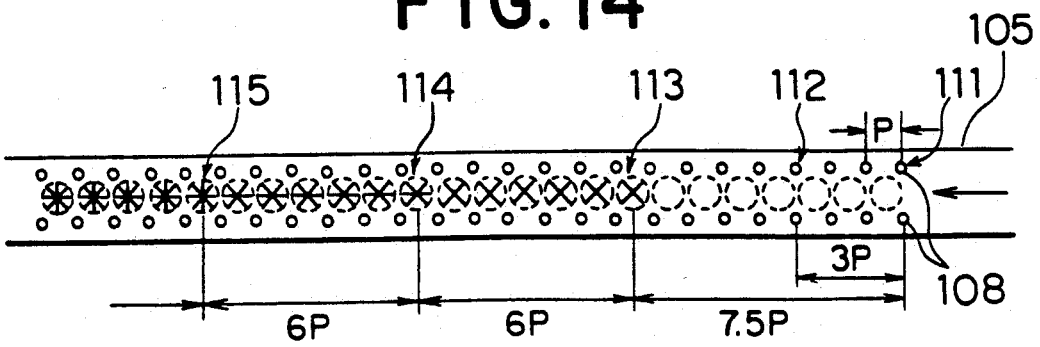

FIG. 14 is a diagram of assistance in explaining another example of machining in the first embodiment of this invention. Like parts are indicted by like reference numerals in FIG. 13.

FIG. 14 illustrates the state of machining when $n=3$, $k=7$, and $i=j=6$ in the embodiment shown in FIG. 12. That is, an indexing-pitch feed P of the workpiece 105 is set to be $\frac{1}{3}$ of the distance between the positions of the pilot holes 108 provided with the pilot machining means 101a and the positions of the pilot pins of the pilot guide means 101b, while the first machining means 102 is installed at a position 7.5P away from the position of the pilot machining means 101a, the second machining means 103 at a position 6P away from the first machining means 102, and the third machining means 104 at a position 6P away from the position of the second machining means 103, respectively.

In FIG. 14, the pilot holes 108, 108 are first punched by the pilot machining means 101a at positions shown by arrow 111 as the workpiece 105 is moved by every indexing-pitch feed. The pilot pins are then engaged by the pilot guide means 101b with the pilot holes 108, 108 at positions shown by arrow 112 as the workpiece 105 is moved by every three indexing-pitch feeds. Consequently, even if there are some errors in indexing-pitch feed, the feed of the workpiece 105 is corrected at every three indexing-pitch feeds. As a result, the first machining position 113 machined by the first machining means 102, the second machining position 114 machined by the second machining means 103, and the third machining position 115 machined by the third machining means 104,—are positioned accurately, and thereby products are manufactured at high precision. Symbols X, ✱ , * schematically indicate the state of machining by the machining means 102 through 104, as in the case with the example of machining shown in FIG. 13.

In the foregoing, examples of machining with the index-feed machining system of this invention shown in FIG. 12 have been described, referring to FIGS. 13 and 14. High-precision products can be manufactured with good yield by appropriately selecting the values n, k, i, j, - - - shown in FIG. 12 in accordance with the size of product to be machined. The machining positions in each of the aforementioned machining processes can be positioned with the highest accuracy in the example of machining shown in FIG. 13, in which the pilot pins are engaged by the pilot guide means 101b with the pilot holes 108, 108 as the workpiece 105 is fed by every indexing pitch.

As described above, this invention makes it possible to accurately maintain the distance P between the pilot holes 108 provided at every indexing pitch by integrally constructing both the pilot machining means 101a and the pilot guide means 101b. In order to further improve machining accuracy, however, the positioning accuracy of the machining means 102 through 104 is equally important. Each of the machining means 102 through 104 in the index-feed machining system of this invention has a positioning means that is capable of accurate positioning with simple operations.

In the following, positioning means equipped with the machining means 102 through 104 of this invention will be described, referring to FIGS. 15 through 17.

Figure 15:
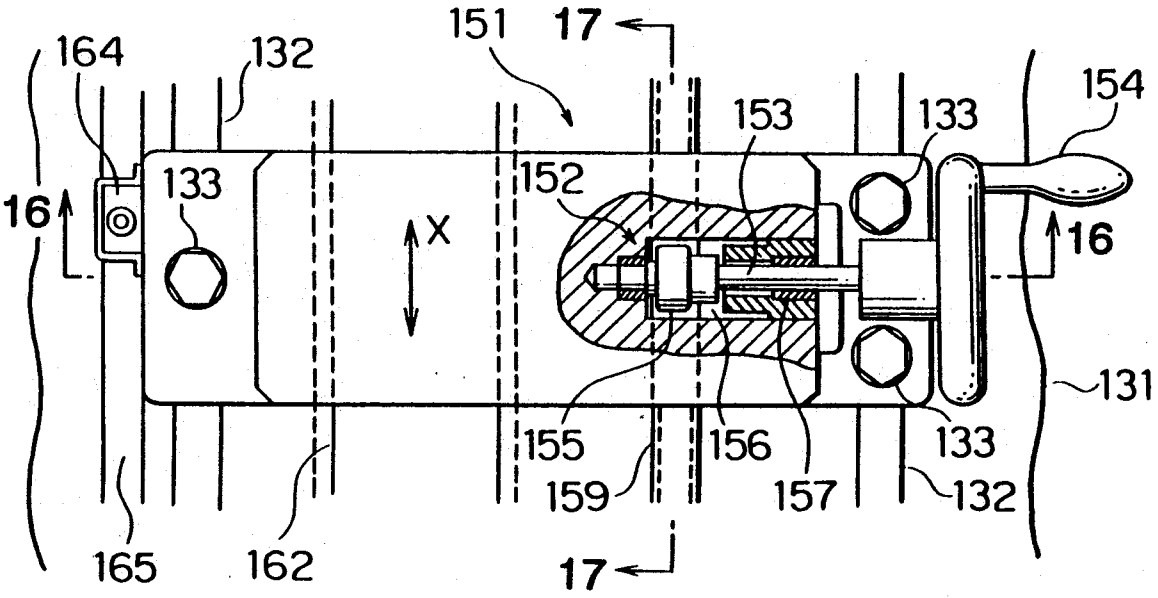
FIGS. 15 and 16 are a plan view and a cross-sectional side view of the essential part of an example of machining means in the first embodiment of this invention.
Figure 16:
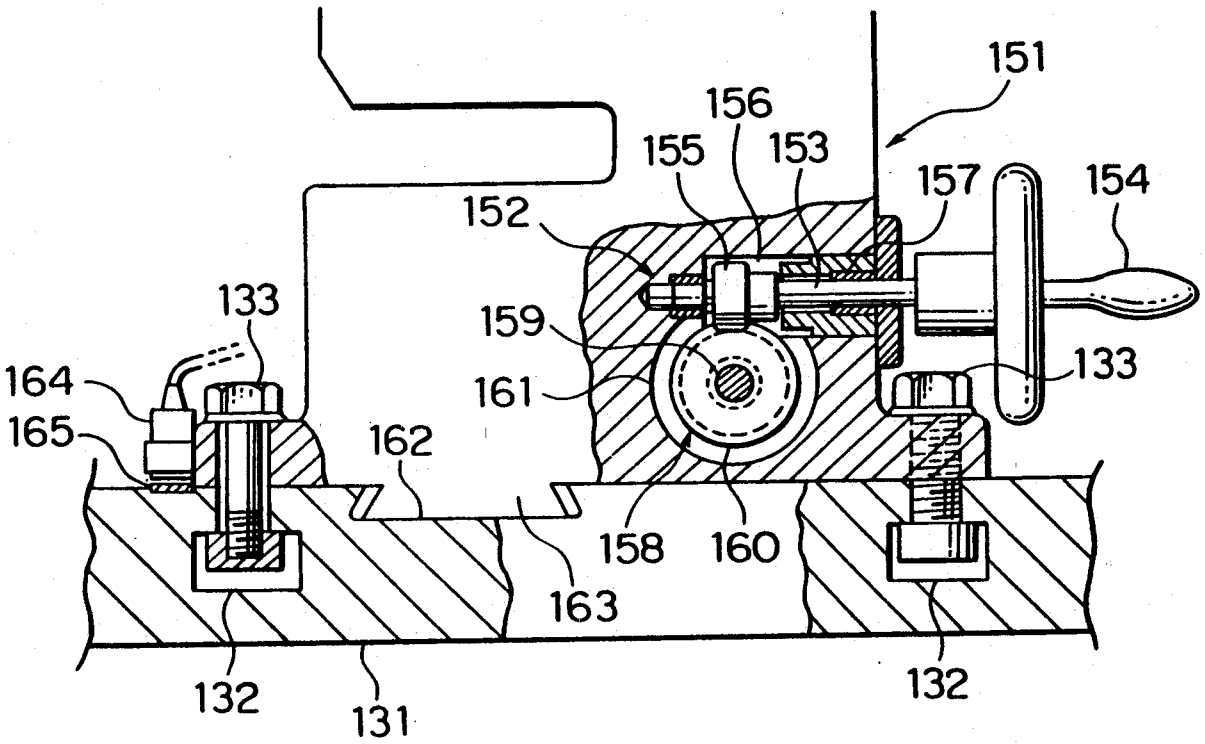

In this invention, accurate positioning can be performed with simple operations since each machining means has a means for positioning the mounting position thereof, as shown in FIGS. 15 and 16. FIG. 15 is a plan view, including the cross-section of the essential part, of assistance in explaining the machining means of this invention, and FIG. 16 a side view, including the cross-section of the essential part taken along line 16—16 in FIG. 15.

In FIGS. 15 and 16, numeral 151 refers to a machining means proper according to this invention. In FIGS. 15 and 16, although only one machining means proper 151 is shown, the machining means proper of other machining means are also provided. The machining means proper 151 is installed on the press table 131 with mounting bolts 133 using T grooves 132.

Numeral 152 indicates a drive unit consisting of a driving shaft 153, a driving handle 154 for driving the driving shaft 153, and a driving spiral gear 155 fixedly fitted to the driving shaft 153. The drive unit 152 is rotatably installed in a drive unit housing 156 formed in the machining means proper 151. The axial direction of the driving shaft 153 is disposed at right angles with the feeding direction (in the direction shown by arrow X in FIG. 15) of the workpiece (not shown).

Numeral 158 indicates a driven portion consisting of a threaded shaft 159 fixedly fitted to the press table 131, and a driven spiral gear 160 having a female thread that engages with the threaded shaft 159, and meshing with the driving spiral gear 155. The driven portion 158 is installed in a driven portion housing 161 formed in such a fashion as to pass through the machining means proper 151. The axial direction of the threaded shaft 159 is in parallel with the feeding direction of the workpiece.

Numeral 162 indicates a dovetail groove, and 163 a dovetail, both being a well-known high-precision sliding means commonly used in machine tools. The dovetail groove 162 and the dovetail 163 are formed in the direction parallel to the feeding direction of the workpiece.

Numeral 164 indicates a position sensor; and 165 a measuring scale, both being a well-known position sensing means. Using these position sensing means, the position of the machining means proper 151 in the direction shown by arrow X can be accurately measured. The measuring results with the position sensing means are displayed with a digital display (not shown), for example.

In the foregoing, the construction of the positioning means incorporated in each machining means in the index-feed machining system of this invention has been described, referring to FIGS. 15 and 16. Next, positioning operations will be described, referring to FIG. 17. FIG. 17 is a cross-section taken along line 17—17 in FIG. 15. Like parts are indicated by like numerals shown in FIGS. 15 and 16. Numerals 151*a*, 151*b* and 151*c* are machining means proper; the machining means proper 151*b* may be considered as corresponding to the machining means 151 shown in FIGS. 15 and 16, and the machining means proper 151*a* and 151*c* are provided adjacent to the machining means proper 151*b*. Numeral 166 indicates a flange; 167 a cylindrical spacer; 168 a bearing; 169 a bellows; and 170 a flange-mounting recess, respectively.

Figure 17:
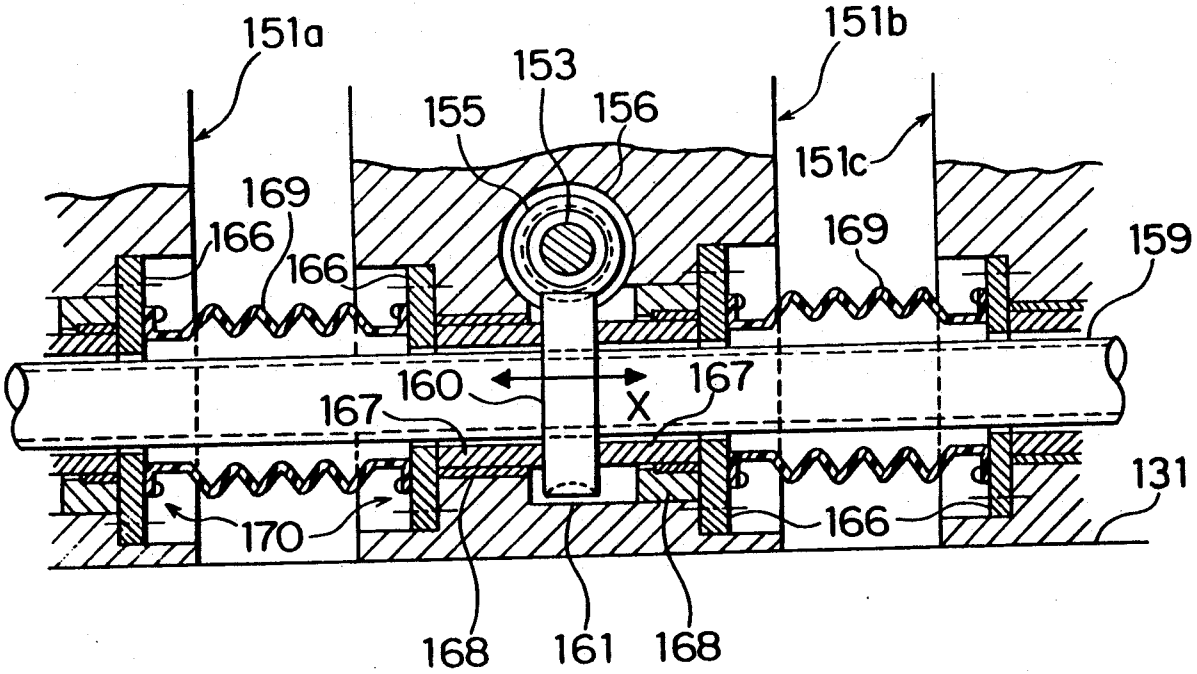
FIG. 17 is a diagram of assistance in explaining the operation of the example of machining means shown in FIGS. 15 and 16.

In FIG. 17, the driving shaft 153 is driven clockwise or counterclockwise using the driving handle 154 (FIGS. 15 and 16). As the driving shaft 153 is rotated, the driving spiral gear 155 is also rotated. As the driving spiral gear 155 is rotated, the driven spiral gear 160 engaging with the driving spiral gear 155 is also rotated. The driven spiral gear 160, which is in mesh with the threaded shaft 159 fixedly fitted to the press table 131, is moved along the threaded shaft 159 in the direction shown by arrow X in the figure. On both sides of the driven spiral gear 160 installed is a cylindrical spacer 167 in the driven portion housing 161 via a bearing means 168 in such a fashion that the spacer 167 is interposed between the side of the driven spiral gear 160 and the flange 167. One cylindrical end face of the spacer 167 is adapted to slidably come in contact with the side of the driven spiral gear 160, and the other cylindrical end face thereof with the flange 166, respectively. The presence of the spacer 167 therefore allows the driven spiral gear 160 to be moved in the direction shown by arrow X in the figure without changing the relative positions with the driving spiral gear 155. That is, as the driven spiral gear 160 moves, the machining means proper 151*b* also moves in the direction shown by arrow X in the figure along the dovetail groove 162 (shown in FIGS. 15 and 16). The bellows 169 prevents foreign matter from entering the threads of the threaded shaft 159. The bellows 169 may be replaced with an expandable protective member, such as a screw cover, which will be described later. In FIG. 17, since the flange 166 to which both ends of the bellows 169 are fixed is installed in the flange-mounting recess 170 formed by machining the side of the machining means proper 151*b*, a spacer for housing the bellows 169 can be secured even if there is only a small clearance between the machining means proper 151*a* and the machining means proper 151*b*, for example.

In the foregoing, positioning operations of machining means in the index-feed machining system of this invention have been described, referring to FIG. 17. Needless to say, the machining means proper 151 is made slidable along the dovetail groove 162 prior to positioning operations by loosening the mounting bolts 133 (shown in FIGS. 15 and 16). And then, the machining means proper 151 is moved to a desired position, and fixed with the mounting bolts 133 using the T groove 132, as described above. Positioning can be performed easily and accurately since the position of the machining means proper 151 is displayed on the digital display.

Figure 18:
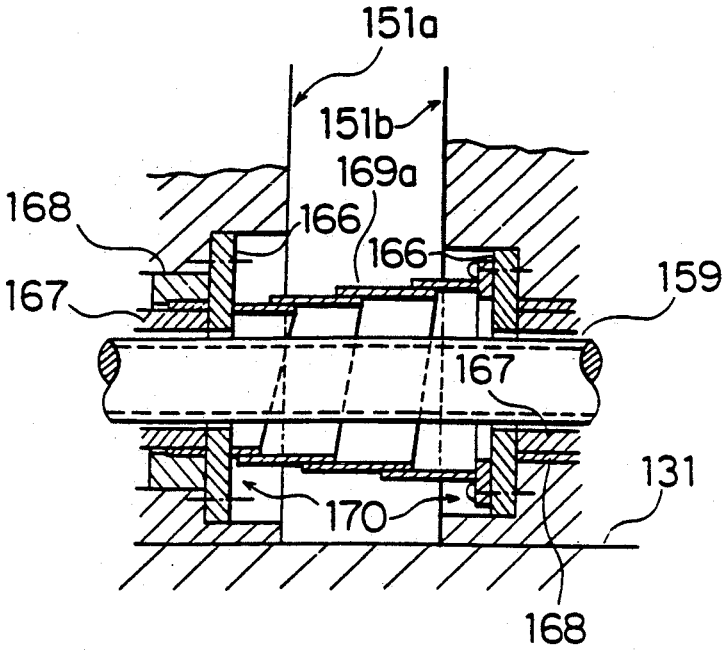
FIG. 18 is a cross-section of the essential part of another example of protective means in FIG. 17.

FIG. 18 is a cross-section of the essential part of another example of the protective means shown in FIG. 17. Like parts are indicated by like numerals shown in FIG. 17. In FIG. 18, numeral 169*a* indicates a screw cover formed by spirally winding strip steel into a hollow cylinder that is axially expandable and interposed between the flanges 166, 166. This construction prevents foreign matter from entering the thread of the threaded shaft 159.

Figure 19:
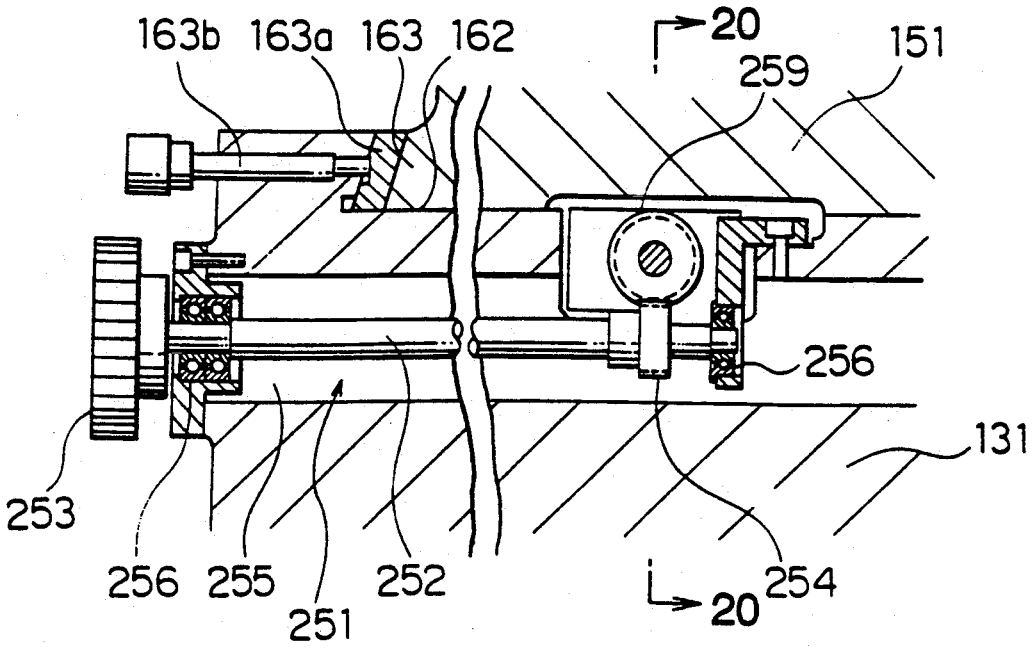
FIG. 19 is a cross-sectional side view of the essential part of another example of the mechanism for moving machining means.
Figure 20:
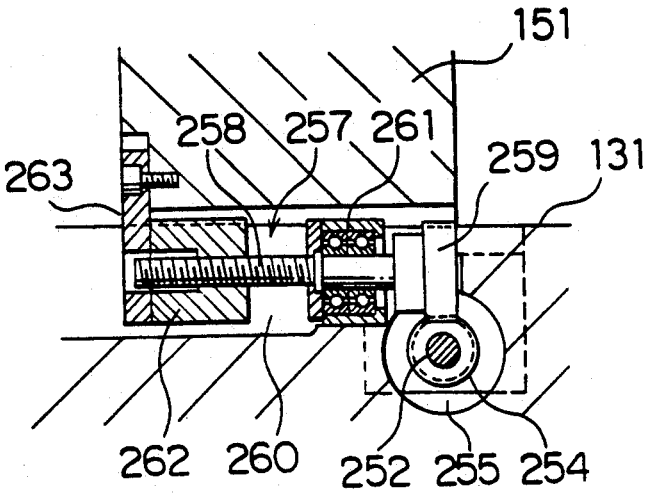
FIG. 20 is a cross-section taken along line 20—20 in FIG. 19.

FIG. 19 is a side view, including the cross-section of the essential part, illustrating another example of the machinism for moving the machining means, and FIG. 20 is a cross-section taken along line 20—20 in FIG. 19. Like parts are indicated by like numerals shown in FIGS. 15 and 16.

In FIGS. 19 and 20, the machining means proper 151 is slidably disposed in the dovetail groove 162 provided on the press table 131 via the dovetail 163. Numeral 163*a* indicates a spacer, and 163*b* a clamping screw.

Numeral 251 indicates a drive unit consisting of a driving shaft 252, a driving handle 253 for driving the driving shaft 252, and a driving spiral gear 254 fixedly fitted to one end of the driving shaft 252. The drive unit 251 is rotatably installed in a drive unit housing 255 formed on the press table 131 via a bearing means 256. The axial direction of the driving shaft 252 is at right angles with the feeding direction of the workpiece.

Numeral 257 is a driven portion consisting of a threaded shaft 258, and a driven spiral gear 259 fixedly fitted to one end of the threaded shaft 258 and engaging with a driving spiral gear 254. The driven portion 257 is rotatably installed in a driven portion housing 260 formed on the press table 131 via a bearing means 261. The axial direction of the threaded shaft 258 is in parallel with the feeding direction of the workpiece.

Numeral 262 indicates a female thread installed on the lower part of a machining means proper 151 via a mounting member 263 and disposed so as to mesh with the threaded shaft 258.

With the above construction, the driving shaft 252 is rotated with the driving handle 253 in the state where the clamping screw 163*b* is loosened. With the rotation of the driving shaft 252, the driven spiral gear 259 engaging with the driving spiral gear 254 is also rotated. As a result, the rotation of the threaded shaft 258 causes the female thread 262 engaging with the threaded shaft 258, and the machining means proper 151 having the female thread 262 to move in the right-left direction in FIG. 20, that is, in the feeding direction of the workpiece. After moved to a desired position, the machining means proper 151 is fixedly fitted with the clamping screw 163*b* shown in FIG. 19. The positioning means for the machining means proper 151 is the same as shown in FIGS. 15 and 16.

Figure 21:
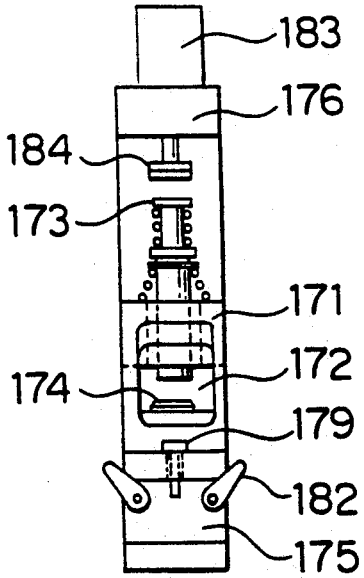
FIGS. 21 and 23 are a front view and a partially cross-sectional side view of the essential part of another example of machining means in the first embodiment of this invention.
Figure 22:
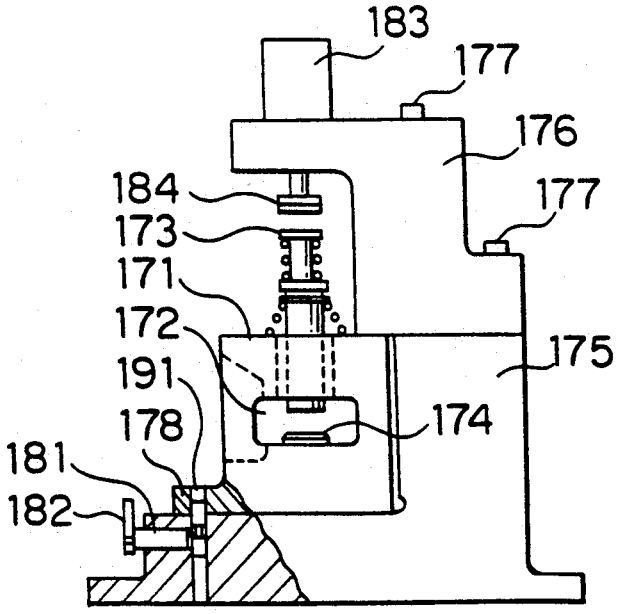

FIGS. 21 and 22 are a front view and a partially sectional side view of another example of machining means in the first embodiment of this invention. In both figures, numeral 171 indicates a holder. The holder 171 is formed into a box shape having an opening 172, as will be described later, and a punch 173 and a die 174 are disposed facing each other across the opening 172. Numeral 175 indicates a lower frame formed into an almost L shape, on top of which fixedly fitted via a bolt 177 is an upper frame formed into an almost reversed L shape, and horizontally slidably placed is the holder 171. Numeral 178 indicates a positioning pin; 179 a fixing bolt; 181 a rotary shaft rotatably fitted to the lower frame 175 and vertically movably engaging with the positioning pin 178. Numeral 182 indicates a lever fixedly fitted to a free end of the rotary shaft 181. Numeral 183 in the figure indicates a hydraulic cylinder fitted to the upper frame 176 to cause the punch to operate via a ram 184.

Figure 23:
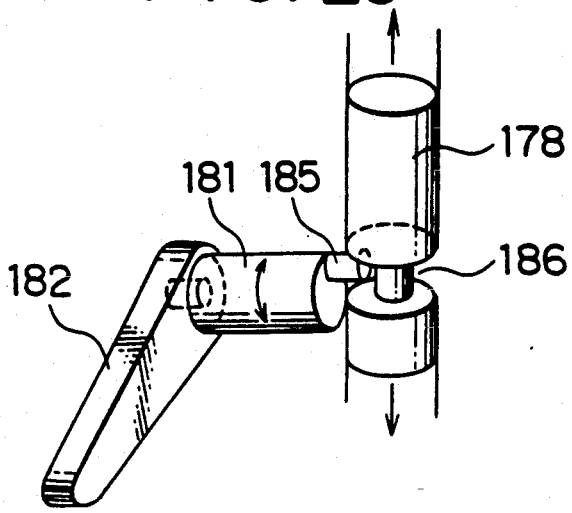

FIG. 23 is an enlarged perspective view illustrating the positioning pin 178, the rotary shaft 181 and the levers 182 shown in FIGS. 21 and 22. In FIG. 23, numeral 185 indicates an offset pin provided off-center and integrally with the tip of the rotary shaft 181, and engaging with a groove 186 provided on the positioning pin 178. With this construction, the positioning pin 178 can be moved vertically by causing the rotary shaft 181 to rotate in the direction shown by arrow in the figure via the levers 182.

Figure 24:
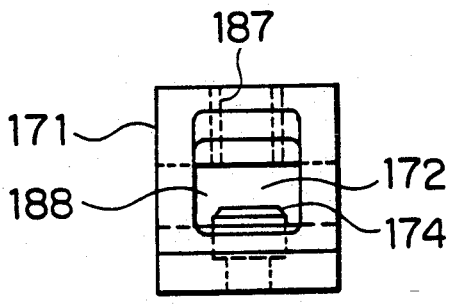
FIGS. 24 through 26 are an enlarged front view, an enlarged side view and an enlarged plan view of other component members shown in FIGS. 21 and 22.
Figure 25:
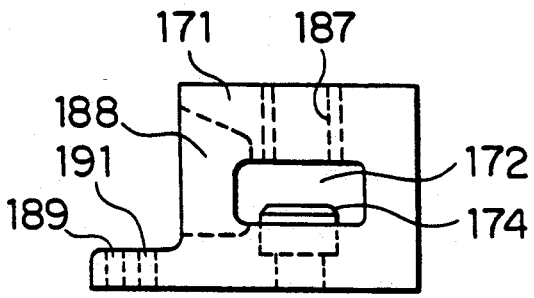
Figure 26:
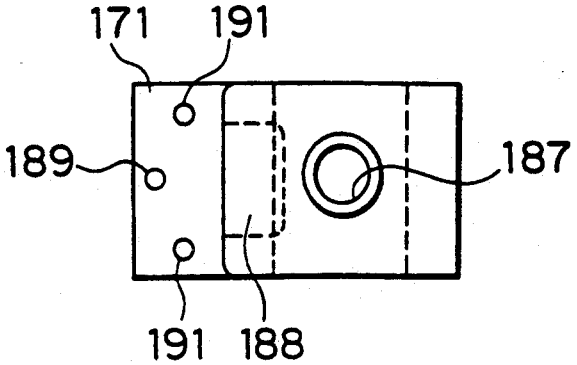

Next, FIGS. 24, 25 and 26 are an enlarged front view, an enlarged side view and an enlarged plan view of the holder 171 shown in FIGS. 21 and 22. In FIGS. 24 through 26, numeral 187 indicates a mounting hole to which the punch 173 shown in FIGS. 21 and 22 is mounted. Numeral 188 is a peep hole provided on the front surface of the holder 171. Numeral 189 indicates a bolt hole, and 191 a positioning hole, into which the fixing bolt 179 and the positioning pin 178 shown in FIGS. 21 and 22 are inserted, respectively.

With the above construction, operations will be described, referring to FIGS. 21 through 26. When the holder 171 is placed on the lower frame 175, and the rotary shaft 181 is caused to rotate via the levers 182, positioning is performed as the positioning pin 178 protrudes upward from the lower frame 175 engages with the positioning hole 191 of the holder 171. At that position, the holder 171 is fixedly fitted to the lower frame 175 via the fixing bolt 179. Predetermined machining operations are performed in this When changing the punch 173, the positioning pin 178 is lowered by causing the levers 182 to rotate, and the fixing bolt 179 is removed. This permits the punch 173 to be slid in front of the holder 171, or leftward in FIG. 22, thereby providing a space above the punch 173 for replacing the punch 173 with a new one. After the punch 173 is installed, the holder 171 is fixedly fitted in the same manner as described above to continue the subsequent machining operations. This construction where the punch 173 and the die 174 can be taken out of the machine, together with the holder 171, offers good workability since it makes it possible to easily replace and position the punch 173 and the die 174. This construction also makes it possible to perform multi-purpose index-feed machining since not only the punch 173 and the die 174 are fitted to the holder 171, but also a spot welder, a measuring instrument, a tapping device or other apparatus can be installed in place of the punch 173 and the die 174.

Figure 27:
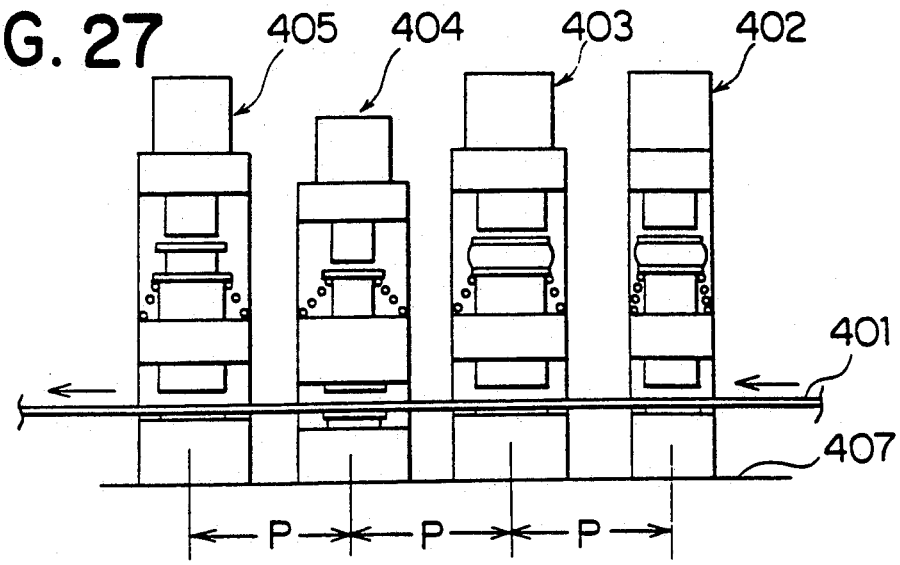
FIG. 27 is a front view of the essential part of a second embodiment of this invention.

FIG. 27 is a front view of the essential part of a second embodiment of this invention.

In FIG. 27, numeral 401 indicates a workpiece; 402 a pilot machining means; 403 through 405 machining means; 407 a press table, respectively.

In the embodiment shown in FIG. 27, the pilot machining means 402 and the machining means 403 through 405 are disposed on the press table 407 at intervals of P, for example, in accordance with machining sequence. The pilot machining means 402 punches pilot holes corresponding to the pilot guide holes 415 shown in FIGS. 28 and 29, which will be described later, on the strip-shaped workpiece 401 that is indexed at pitches of P in the direction shown by arrow in the figure by an automatic feeding means (not shown). The machining means 403 through 405 are disposed in the order of machining sequence. The pilot machining means 402, and the machining means 403 through 405 consist of well-known U-shaped punch-die sets, as shown in FIGS. 28 and 29.

Figure 28:
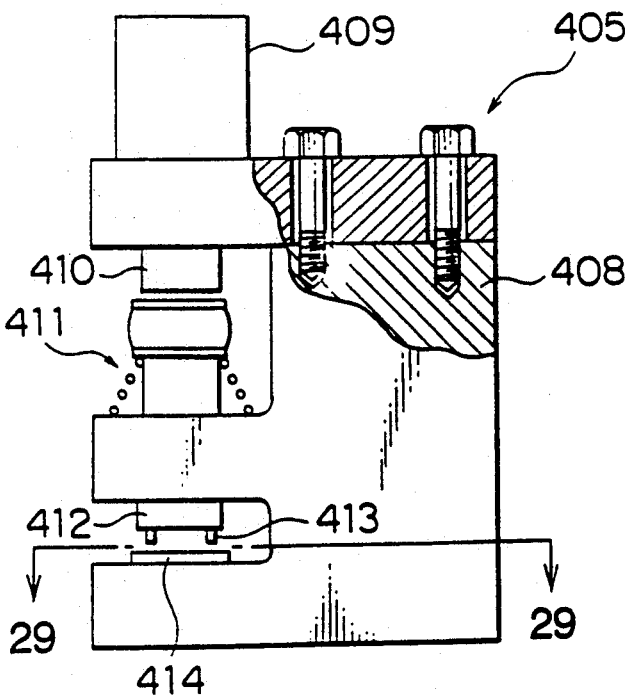
FIG. 28 is a partially cross-sectional side view illustrating the machining means shown in FIG. 27.
Figure 31:
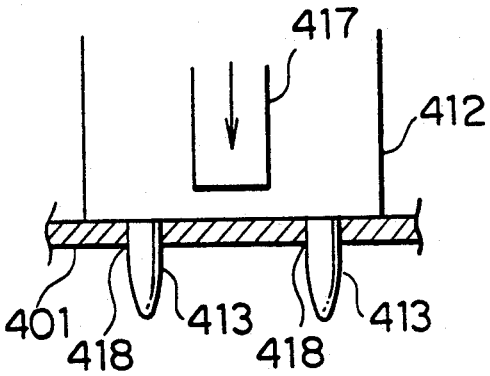
FIGS. 31 through 33 are diagrams of assistance in explaining the operation of the component members of the machining means shown in FIG. 27 during machining.
Figure 32:
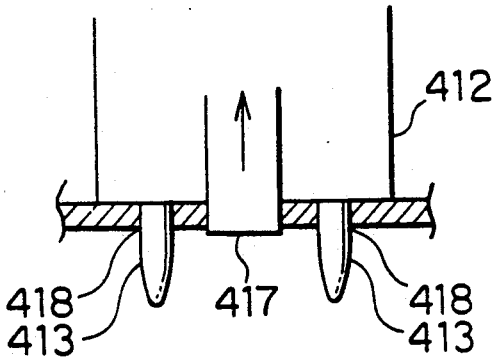
Figure 33:
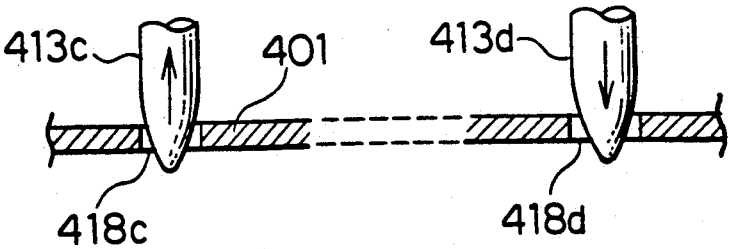

FIG. 28 is a partially sectional side view illustrating an example of machining means in FIG. 27. FIG. 29 is a cross-section taken along line 29—29 in FIGS. 31 through 33 are diagrams of assistance in explaining the operations of component members during machining with machining means shown in FIG. 27. In these figures, numeral 408 indicates a column; 409 a hydraulic cylinder; 410 a press ram; 411 a punch set; 412 a machining head; 413 a pilot pin; 414 a die; 415 a pilot pin guide hole; 416 a machining hole; 417 a punch; and 418 a pilot hole, respectively.

Figure 29:
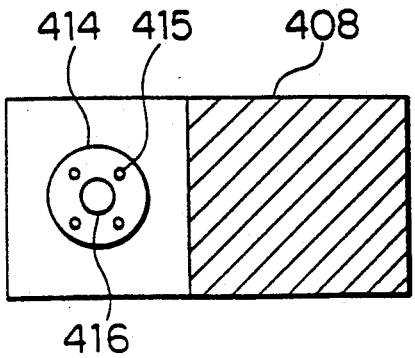
FIG. 29 is a cross-sectional view taken along line 29—29 in FIG. 28.

In FIGS. 28 and 29, the machining means 405 is driven with an independently provided hydraulic cylinder 409. That is, the machining head 412 is forced onto the die 414 by the press ram 410 driven by the hydraulic cylinder 409. At this time, the pilot pins 413 are passed through the pilot holes 418 on the workpiece 401 that is placed on the die 414, and inserted into the pilot pin guide holes 415. This state is shown in FIG. 31. Next, the punch 417 descends and punches a predetermined hole on the workpiece 401. Although the foregoing description is concerned with the machining means 405 for punching operation, other machining means 403 and 404 and the pilot machining means 402 have a similar construction.

The pilot machining means 402 and the machining means 403 through 405 described above are driven independently by hydraulic control means (not shown), such as solenoid valves.

Figure 30:
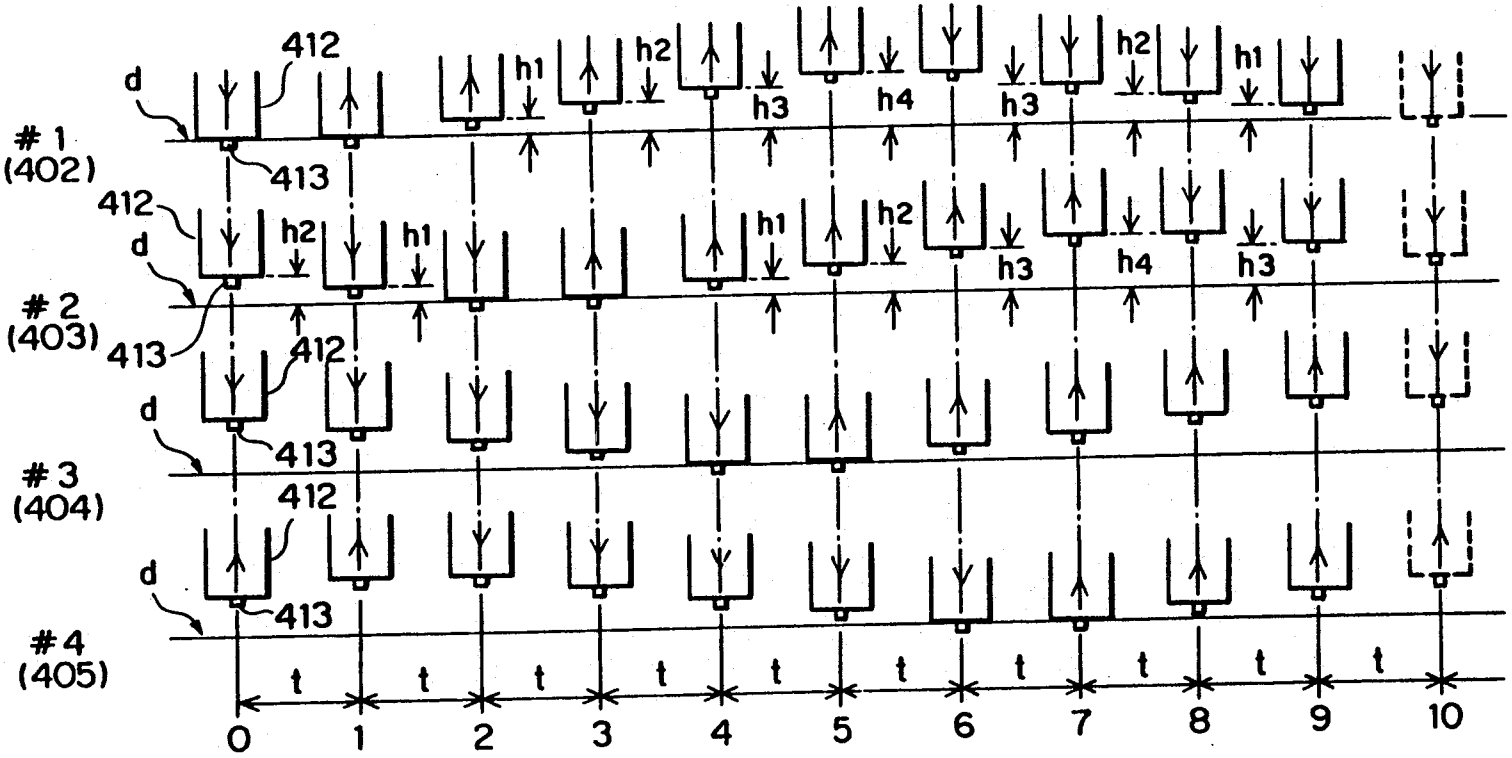
FIG. 30 is a diagram of assistance in explaining the operation of the machining means shown in FIG. 27.

FIG. 30 is a diagram of assistance in explaining the operation of the machining means shown in FIG. 27. Now, the operation and control of the machining means will be described, referring to FIG. 30. In FIG. 30, the state of operation of the machining head 412 of the pilot machining means 402 and the machining means 403 through 405 is shown. #1-#4 indicates the state of operation each of the pilot machining means 402 and the machining means 403 through 405 in accordance with the lapse of a predetermined time (t=0.1 sec., for example). Arrow d in the figure denotes the bottom dead point of the machining head 412 of each machining means.

The state of operation of the machining means 403, for example, of this invention is repeated with a time lag of 2t from the state of operation of the preceding pilot machining means 402, as shown in FIG. 30. Now, the operating state of the pilot machining means 402 and the machining means 403 as a typical example will be described in the following, referring to #1 and #2 in FIG. 30. At timing 0, the machining head 412 of the pilot machining means 402 arrives at the bottom dead point to perform the machining of a pilot hole 418. At this time, the machining head 412 of the machining means 403 is located at a position $h_2$ away from the bottom dead point.

At timing 1 after the lapse of t seconds, the machining head 412 of the pilot machining means 402 begins ascending from the bottom dead point. At this time, the machining head 412 of the machining means 403 is located at a position $h_1$ away from the bottom dead point.

At timing 2, moreover, the machining head 412 of the pilot machining means 402 arrives at a position $h_1$ away from the bottom dead point. At this time, the machining head 412 of the machining means 403 reaches the bottom dead point to perform machining operations illustrated in FIGS. 31 and 32. During these machining operations, the pilot pins 413 remain engaged with the pilot holes 418 on the workpiece 401.

At timing 3, the machining head 412 of the machining means 403 begins ascending from the bottom dead point, while the machining head 412 of the pilot machining means 402 arrives at a position $h_2$ away from the bottom dead point.

After that, the machining head 412 of the pilot machining means 402 arrives at positions $h_3$ and $h_4$ away from the bottom dead point at timings 4 and 5, respectively, then begins descending at timing 6, and arrives at positions $h_3$, $h_2$ and $h_1$ away from the bottom dead point at timings 7, 8 and 9, respectively. At timing 10, the operating state is returned to the same state as at timing 0 to proceed to the next operation.

During this period, the machining head 412 of the machining means 403 arrives at positions $h_1$, $h_2$, $h_3$, $h_4$, $h_4$ and $h_3$ away from the bottom dead point at timings 4 through 9, respectively. At timing 10, the operating state is returned to the same state as at timing 0.

An indexing feed of the workpiece 401 is accomplished during the period from timing 8 to timing 9 when any of the pilot pins 413 of the pilot machining means 402 and the machining means 403 through 405 are not engaged with the pilot holes 418. The machining means 404 and 405 perform machining operations sequentially with time lags of 2t, as shown in #3 and #4 in FIG. 30.

During the period from timing 0 to timing 7 in a series of machining processes with the pilot machining means 402 and the machining means 403 through 405, any of the pilot pins 413 of the pilot machining means 402 and the machining means 403 through 405 are engaged with the pilot holes 418. The state of engagement of the pilot pins 413 with the pilot holes 418 during the period from timing 3 to 4 in #2 and #3 in FIG. 30, for example, is such that before an engagement of the pilot pin 413*c* of the machining means 403 with the pilot hole 418*c* is released, a new engagement of the pilot pin 413*d* of the machining means 404 with the pilot hole 418*d* is started. In a series of machining processes using the pilot machining means 402 and the machining means 403 through 405, the pilot pins 413 of any one of the pilot machining means 402 and the machining means 403 through 405 are engaged with the pilot holes 418, and the machining processes are not restricted by the pilot pins 413 of other machining means. Thus, machining positions during machining using the next machining means can be precisely maintained even when an unwanted expansion or shrinkage is caused on the workpiece 401 by the preceding machining. This eliminates the need for a space in the inside diameter of the pilot hole 418, leading to an improvement in the accuracy of machining positions.

In this invention in which pilot pins 413 are provided on each of the machining means 403 through 405, the need for installing a pilot guide device (a U-shaped pilot guide 60 in FIG. 4) as found in the prior art can be eliminated, and thereby the line length of the index-feed machining system can be reduced.

Though not shown in the figure, a device for vibrating the workpiece 401 in the horizontal direction may be provided to facilitate the engagement of the pilot pins 413 with the pilot holes 418.

The embodiment of this invention shown in FIG. 27, which has been described, referring to FIGS. 27 through 33 is concerned with an index-feed machining system in which 4 units of machining means are installed. This invention, however, is not limited to this construction, and can be applied to an index-feed machining system comprising a plurality of machining means. In such a case, timings (0–10 in FIG. 30) of machining operations have to be changed.

Figure 34:
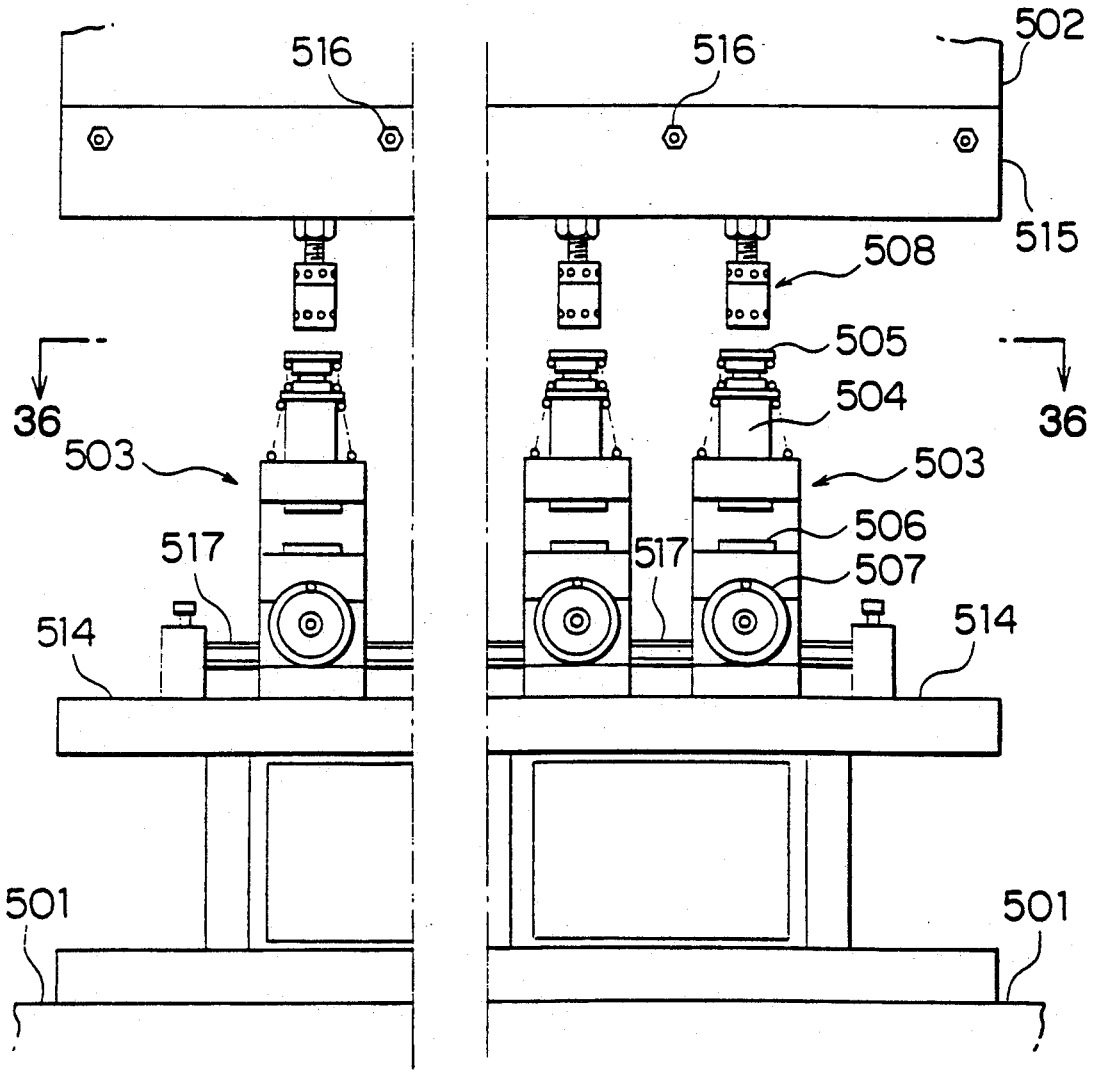
FIGS. 34 and 35 are a front view and a side view of the essential part of a third embodiment of this invention.
Figure 35:
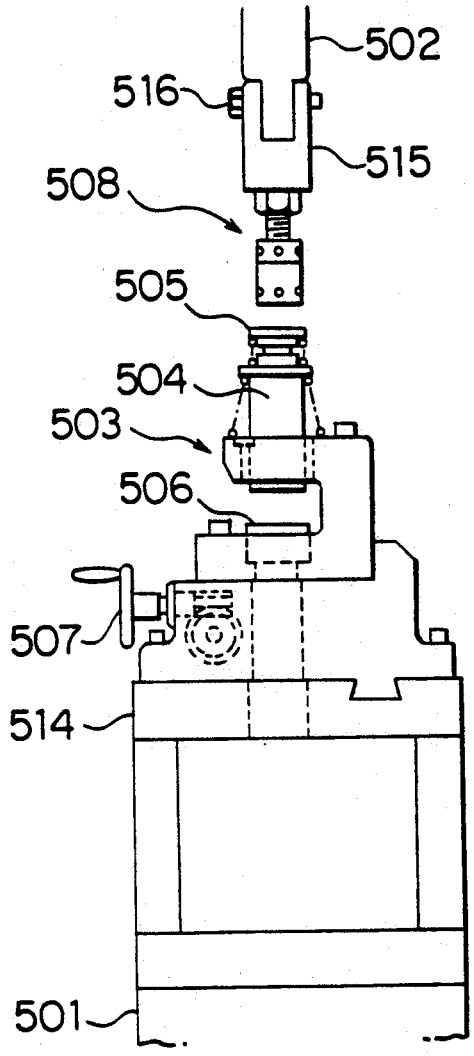
Figure 36:
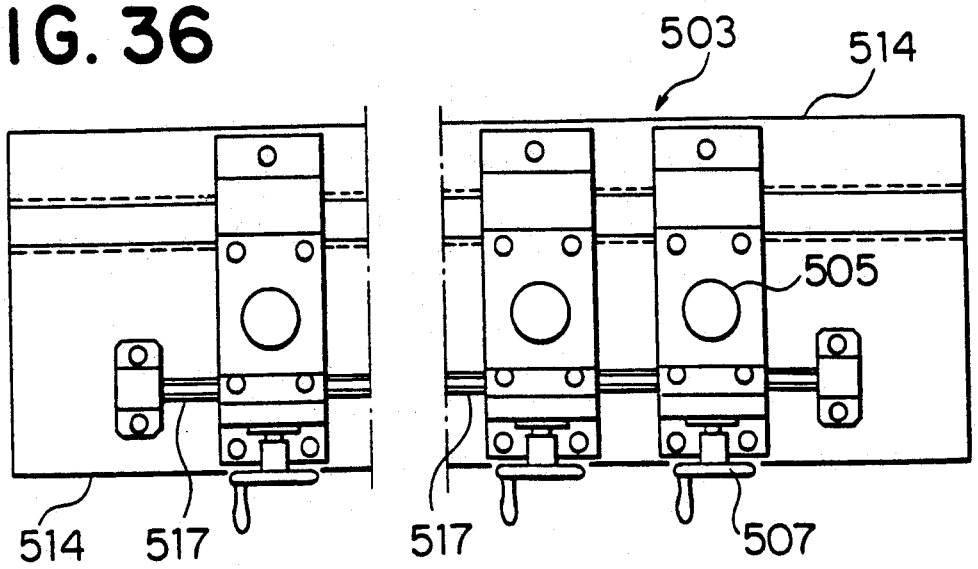
FIG. 36 is a plan view taken in the direction of the arrows along line 36—36 in FIG. 34.
Figure 37:
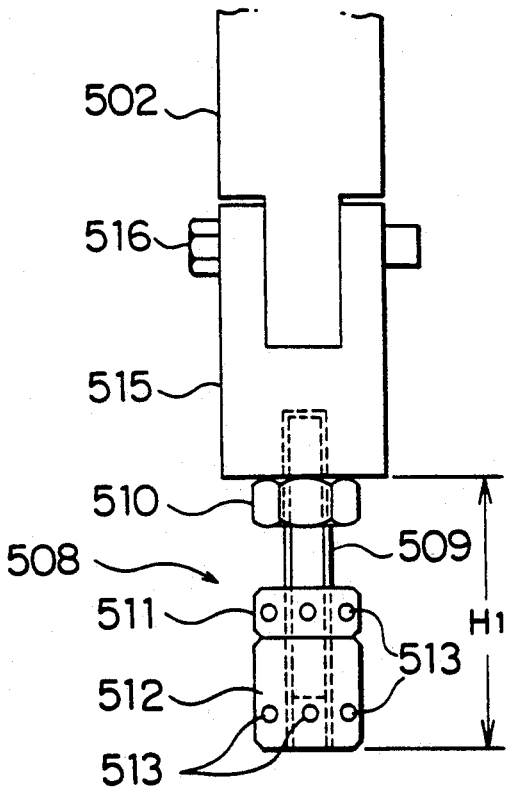
FIG. 37 is an enlarged side view illustrating the bottom dead point adjusting means in FIG. 34.

FIGS. 34 and 35 are a front view and a side view of the essential part of a third embodiment of this invention. FIG. 36 is a plan view viewed in the direction shown by arrow 36—36 in FIG. 34. FIG. 37 is an enlarged side view illustrating the bottom dead point shown in FIG. 35. In these figures, numeral 501 indicates a machining base of the press brake; 502 a ram of the press brake; 503 a punch-die set; 504 a punch; 505 a punch head; 506 a die; 507 a position adjusting handle; 508 a bottom dead point adjusting means; 509 a threaded shaft; 510 a threaded shaft fixing nut; 511 and 512 adjusting nuts; 513 an adjusting hole; 514 a press table; 515 a ram plate; 516 a ram plate fixing bolt; and 517 a position adjusting lead screw, respectively.

In the index-feed machining system embodying this invention shown in FIGS. 34 through 36, N pieces of the punch-die sets 503 for performing machining operations corresponding to a plurality of machining operations are sequentially disposed on the press table 514 installed on the machining base 501 of a press brake in the feeding direction of a workpiece (not shown), and bottom dead point adjusting means 508 for adjusting the bottom dead points of the punches 504 corresponding to the punch-die sets 503 are installed on the bottom surface of the ram plate 515 fixedly fitted to the ram of the press brake via the ram plate fixing bolts 516.

The bottom dead point adjusting means 508 comprises a threaded shaft 509 screwed onto the ram plate 515, a fixing nut 510 for fixing the threaded shaft 509 to the ram plate 515, and two adjusting nuts 511 engaging with the threaded shaft 509, as shown in FIG. 37. The height $H_1$ of the bottom dead point adjusting means 508 can be easily adjusted by vertically moving the position of the adjusting nut 512 mounted at the tip of the bottom dead point adjusting means 508 by loosening the adjusting nut 511. That is, provision on the bottom dead point adjusting means 508 on each of the punch-die sets 503, as shown in FIG. 34, allows the bottom dead point of the punches 504 of the punch-die sets 503 to be easily adjusted by adjusting the bottom dead point adjusting means 508.

In the embodiment shown in FIGS. 34 through 37, which has been described above, predetermined index-feed machining operations are performed as the ram 502 of the press brake is driven in accordance with the indexing feed of the workpiece, and thereby the bottom dead point adjusting means 508 push the punch heads 505 of the punches 504. The position adjusting handles 507 are used for adjusting the positions of the punch-die sets 503 along the position adjusting lead screw 517 via a drive means (refer to FIGS. 15 through 17, for example) incorporated in each of the punch-die sets 503.

Figure 38:
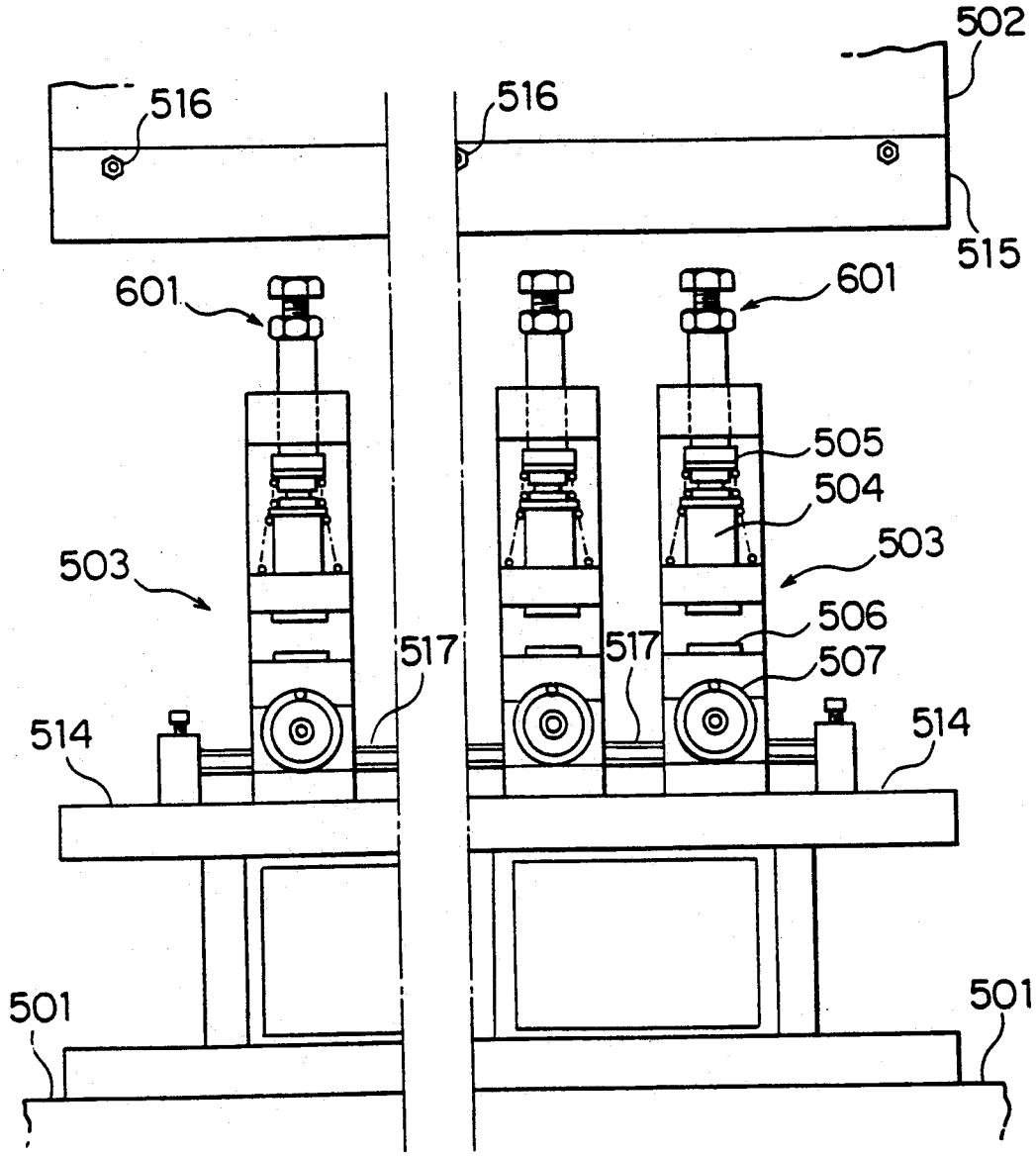
FIGS. 38 and 39 are a front view and a side view of the essential part of a fourth embodiment of this invention.
Figure 39:
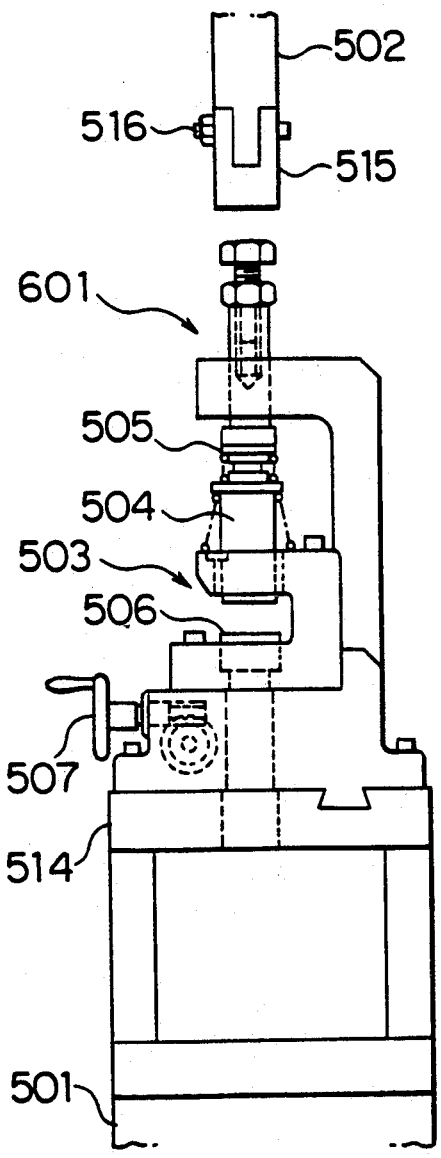
Figure 40:
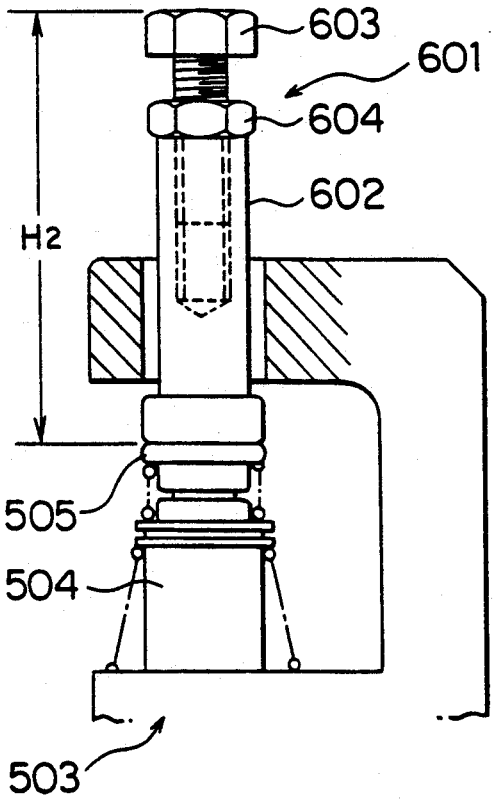
FIG. 40 is an enlarged side view illustrating the bottom dead point adjusting means shown in FIG. 38.

FIGS. 38 and 39 are a front view and a side view of the essential part of a fourth embodiment of this invention. FIG. 40 is an enlarged side view illustrating the bottom dead point adjusting means in FIG. 39. Like parts are indicated by like numerals in FIGS. 34 through 37. In these figures, the bottom dead point adjusting means 601 comprises an adjusting means proper 602 placed on the punch head 505, an adjusting bolt 603 screwed into a threaded hole provided on the adjusting means proper 602, and a fixing nut 604 for fixing the adjusting bolt 603. The height $H_2$ of the bottom dead point adjusting means 601 can be easily adjusted by vertically moving the adjusting bolt 603 by loosening the fixing nut 604. Since the bottom dead point adjusting means 601 are provided on each of the punch-die sets 503, as shown in FIG. 38, the bottom dead points of the punches 504 of the punch-die sets 503 can be easily adjusted by adjusting the bottom dead point adjusting means 601.

The bottom dead point adjusting means in the index-feed machining system of this invention, which has just been described above, is not limited to the construction shown in FIGS. 34 through 40, but any constructions that have essentially the same effects as the embodiment shown in FIGS. 34 through 40 may be used.

Figure 41:
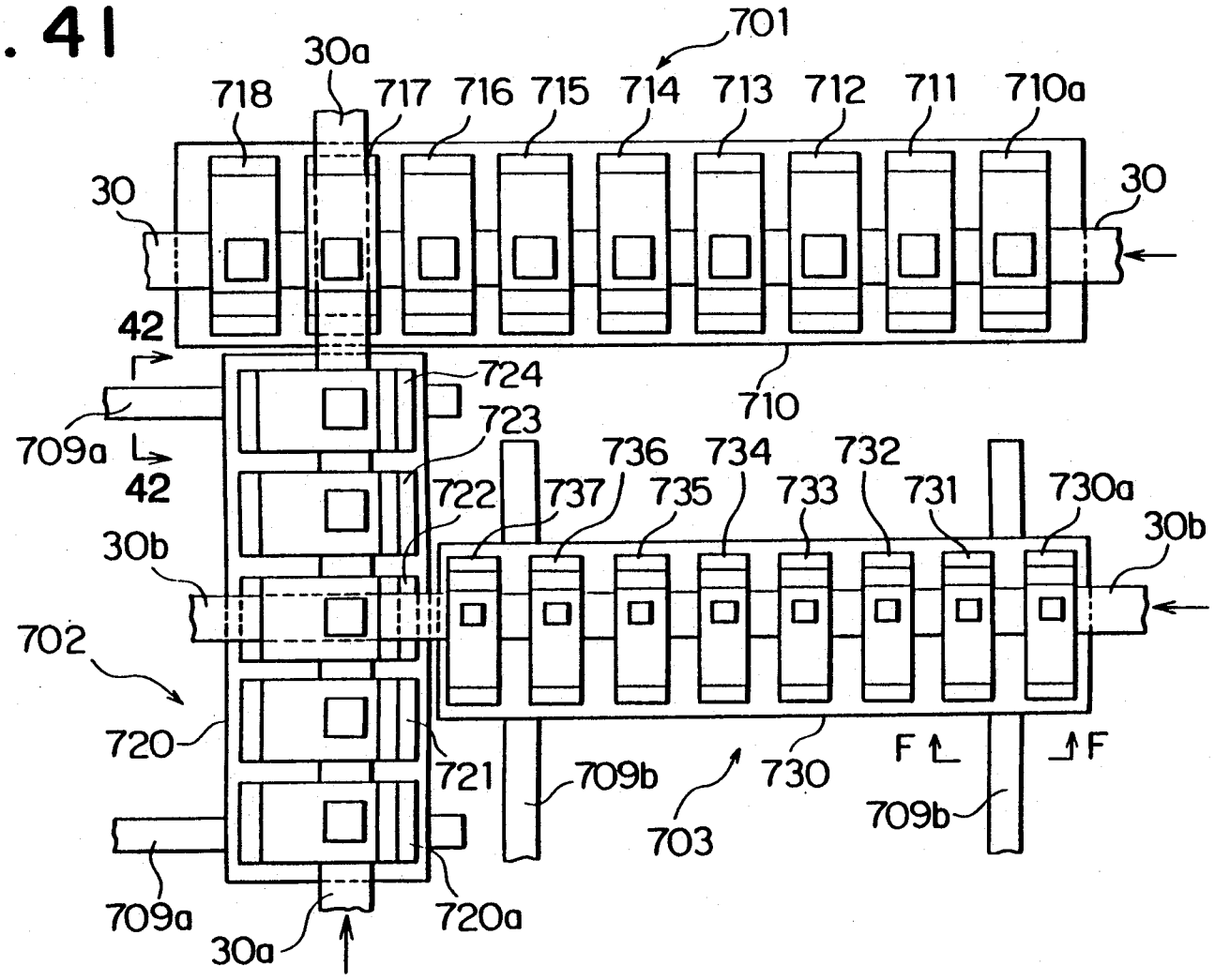
FIG. 41 is a schematic plan view of the essential part of a fifth embodiment of this invention.
Figure 42:
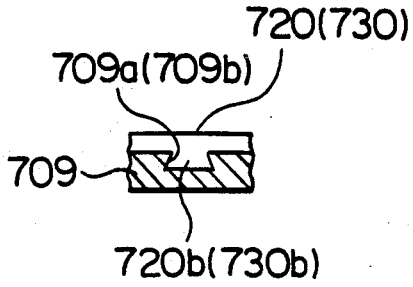
FIG. 42 is a cross-section taken along line 42—42 in FIG. 41.

FIG. 41 is a schematic plan view of the essential part of a fifth embodiment of this invention. FIG. 42 is a cross-section taken along line 42—42 in FIG. 41. In both figures, numeral 701 indicates a main machining line; 702 a first auxiliary machining line; 703 a second auxiliary machining line; the first auxiliary machining line 702 being provided in such a fashion as to orthogonally intersect with the main machining line 701, and the second auxiliary machining line 703 being provided in such a fashion as to orthogonally intersect with the first auxiliary machining line 702, respectively.

First, the construction of the main machining line 701 will be described. Numeral 710 indicates a plate, fixedly fitted to a base plate 709 (refer to FIG. 42) via bolts and other mounting members (not shown). Next, numerals 711–718 indicate punch-die sets, provided sequentially on the base plate 709, set $mP_m$ on center in the longitudinal feeding direction of the workpiece 30. In this case, m is a given positive integer, $P_m$ an indexing pitch of the workpiece 30. Numeral 710*a* indicates a feeding device adapted to feed the workpiece 30 at an indexing pitch of $P_m$ and provided on the upstream side of the punch-die set 711. The punch-die sets 711–718 have essentially the same construction as those in the previously described embodiments, and the same applies to the installation thereof on the plate 710.

Next, the construction of the first auxiliary machining line 702 will be described. Numeral 720 indicates a plate on which the punch-die sets 721–724 are installed $nP_n$ on center in the longitudinal feeding direction of the workpiece 30*a*. In this case, n is a given positive integer, $P_n$ is the indexing pitch of the workpiece 30*a*. n and $P_n$ may sometimes be the same as m and $P_m$ described above, but are not always the same as them. Numeral 720*a* is a feeding device adapted to feed the workpiece 30*a* at an indexing pitch of $P_n$ and provided on the upstream side of the punch-die set 721. The construction and installation of the punch-die set 721–724 are the same as those with the main machining line 701. The first auxiliary machining line 702 is provided in such a manner as to orthogonally intersect with the main machining line 701. A dovetail 720*b* extending in the direction orthogonally intersecting the feeding direction of the workpiece 30*a* is provided on the bottom surface of the plate 720 so that the dovetail 720*b* slidably engages with a dovetail groove 709*a* provided on the surface of the base plate 709.

The second auxiliary machining line 703 has essentially the same construction as that of the first auxiliary machining line 702.

That is, the punch-die sets 731–737 are installed $sP_s$ on center in the longitudinal feeding direction of the workpiece 30*b*. In this case, s is a given positive integer, $P_s$ is the indexing pitch of the workpiece 30*b*. The relationship among s and $P_s$, and $P_m$ and n and $P_n$ may sometimes be the same as in the case with the first auxiliary machining line 702, but need not be the same. Numeral 730*a* is a feeding device adapted to feed the workpiece 30*b* at an indexing pitch of $P_s$ and provided on the upstream side of the punch-die set 731. The second auxiliary machining line 703 is provided in such a manner as to orthogonally intersect with the first auxiliary machining line 702. A dovetail 730*b* extending in the direction orthogonally intersecting the feeding direction of the workpiece 30*b* is provided on the bottom surface of the plate 730 so that the dovetail 730*b* slidably engages with a dovetail groove 709*b* provided on the surface of the base plate 709.

Figure 43:
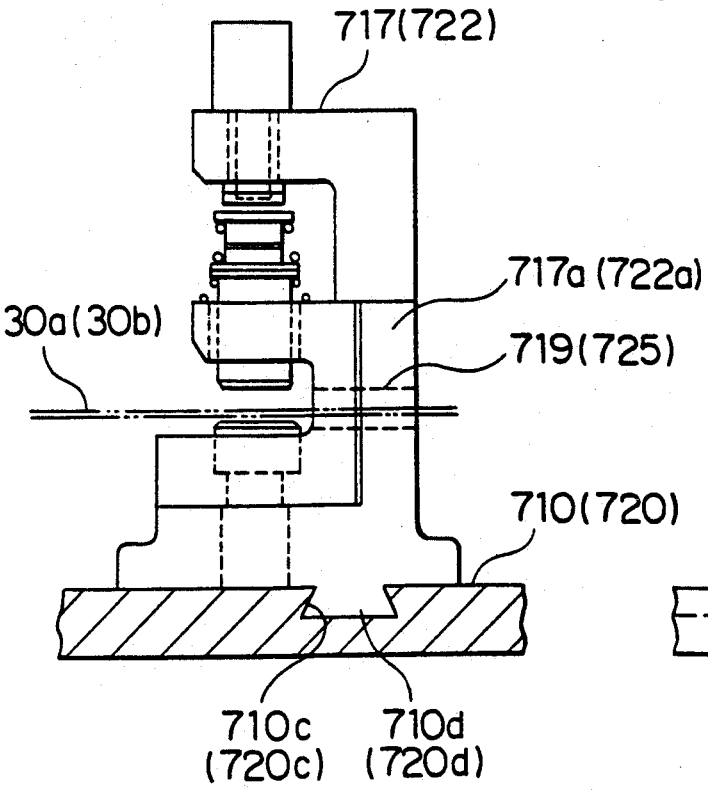
FIGS. 43 and 44 are an enlarged side view and an enlarged rear view of an example of the punch-die set in FIG. 41.
Figure 44:
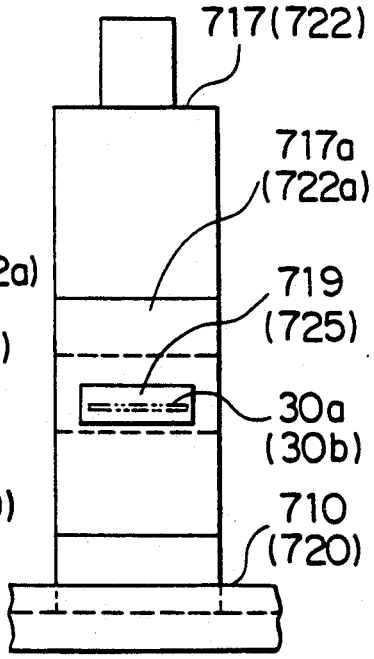
Figure 48:
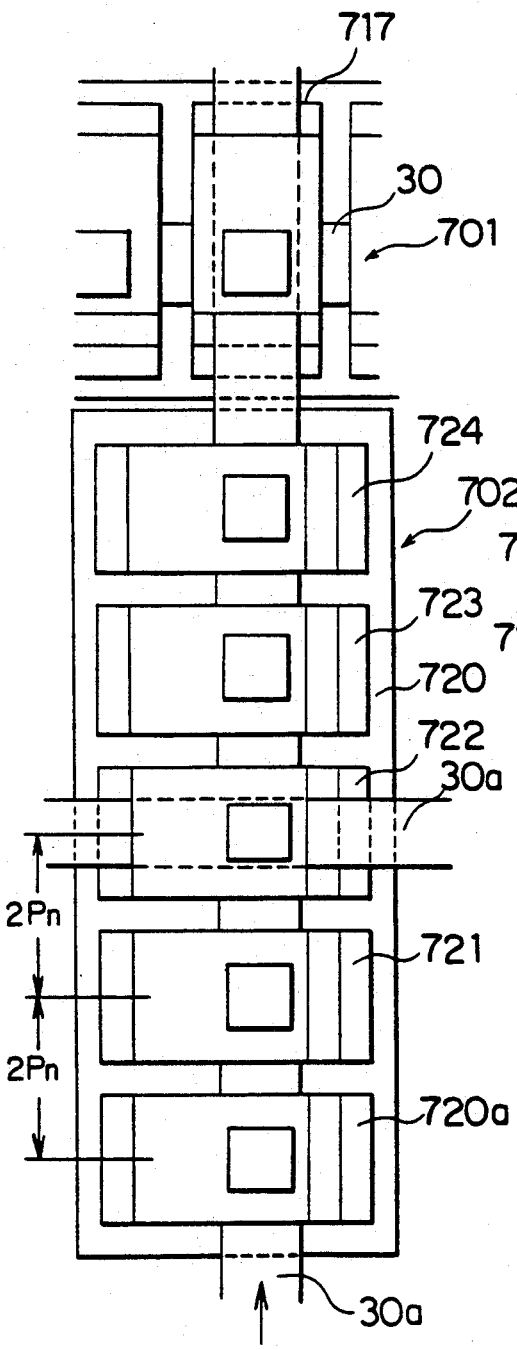
FIG. 48 is an enlarged plan view of the essential part of the first auxiliary machining line.

FIGS. 43 and 44 are an enlarged side view and an enlarged rear view of the essential part of the punch-die sets 717 and 722 shown in FIG. 48. Like parts are indicated by like numerals in FIG. 41. In FIGS. 43 and 44, numerals 710*c* and 720*c* are dovetail grooves provided on the surface of the plate 710 and 720 in parallel with the feeding direction of the workpiece 30 and 30*a* (refer to FIG. 41) and slidably engaged with teh dovetails 710*d* and 720*d* provided on the bottom surface of the punch-die sets 717 and 722. This relationship among these components may be applied to the punch-die sets 711–718, 721–724 and 731–737, and the feeding devices 710*a*, 720*a* and 730*a*. In FIGS. 43 and 44, numerals 719 and 725 indicate passages provided by passing through holder members 717*a* and 722*a* comprising the punch-die sets 717 and 722 so as to permit the workpieces 30*a* and 30*b* to pass, as will be described later.

Figure 45:
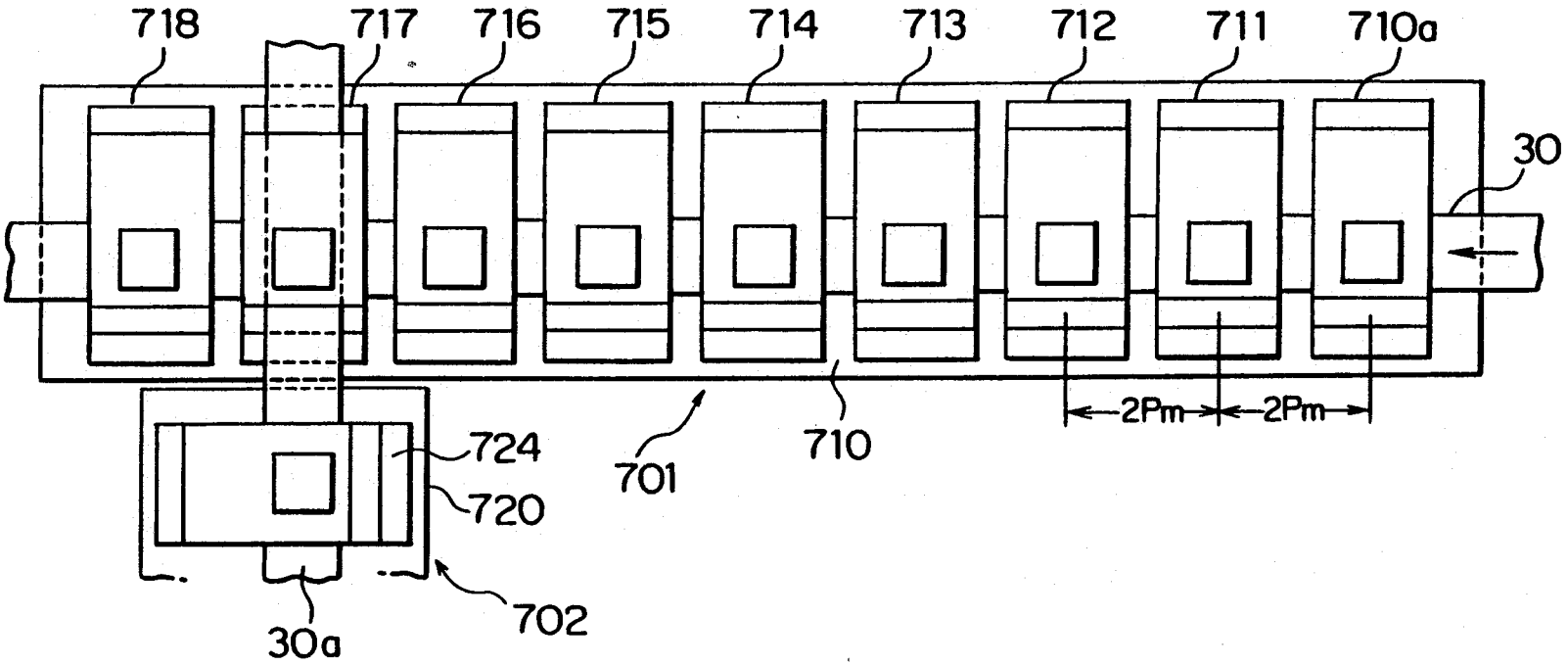
FIG. 45 is an enlarged plan view of the essential part of the main machining line in FIG. 41.
Figure 46:
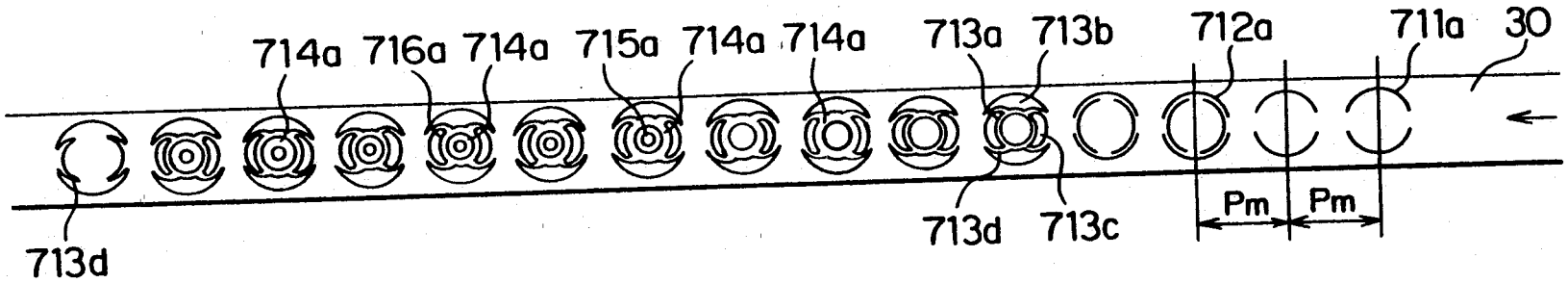
FIG. 46 is a plan view illustrating the state where the workpiece is machined.
Figure 47:
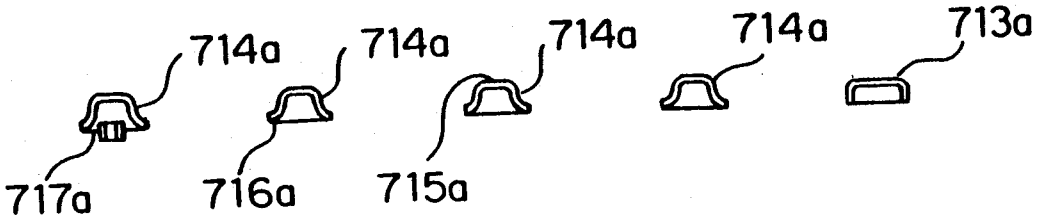
FIG. 47 is a longitudinal section of the essential view of the workpiece at each stage in FIG. 46.

FIG. 45 is an enlarged plan view of the essential part of the main machining line 701 in FIG. 41. FIG. 46 is a plan view illustrating the machining state of the workpiece 30. FIG. 47 is a diagram illustrating the longitudinal sectional shape of the essential part of the workpiece 30 at each stage in FIG. 46. These figures show the same positional relationship throughout. Like parts are indicated by like numerals in FIG. 41. In FIGS. 45 and 46, $P_m$ indicates the indexing pitch of the workpiece 30. The feeding device 710*a* and the punch-die sets 711–718 are disposed $2P_m$ on center. Although the workpiece 30 is usually positioned by punching on the workpiece 30 pilot holes with a punch-die set for machining pilot holes and engaging the pilot holes with pilot guides provided on the machining line, these pilot holes and pilot guides are not shown in the figures for simplification. In FIGS. 45 through 47, as the workpiece 30 is indexed at equal pitches of $P_m$ in the direction shown by an arrow by the feeding device 710*a*, external lances 711*a* are machined with the punch-die set 711. As the workpiece is moved by a pitch of $P_m$, skipped an idle stage, and further moved at a pitch of $P_m$, internal lances 712*a* are machined with the punch-die set 712.

Similarly, a first drawing operation is performed with the punch-die set 713 to form a cup-shaped projection 713*a* on the workpiece 30, and the arc-shaped external and internal lances 711*a* and 712*a* are expanded into crescent-shaped grooves 713*b* and 713*c*. Thus, the cup-shaped projection 713*a* is supported by four arc-shaped bridges 713*d*. Next, a second drawing operation is performed with the punch-die set 714 to for the cup-shaped projection 713*a* into a cap shaped member 714*a* as shown in FIG. 47. A hole 715*a* is provided on the cap-shaped member 714*a*. Then, the external periphery 716*a* of the cap-shaped member 714*a* is trimmed with the punch-die set 716, and thereby the cap-shaped member 714*a* is finished into a predetermined outside diameter. In the punch-die set 717, a composite member 717*a* formed in the first auxiliary machining line 702, which will be described later, and the cap-shaped member 714*a* are combined, and the bridges 713*d* supporting the cap-shaped member 714*a* are cut off with the punch-die set that constitutes the final stage, and thereby a desired assembly, which will be described later, is produced.

Figures 49, 50:
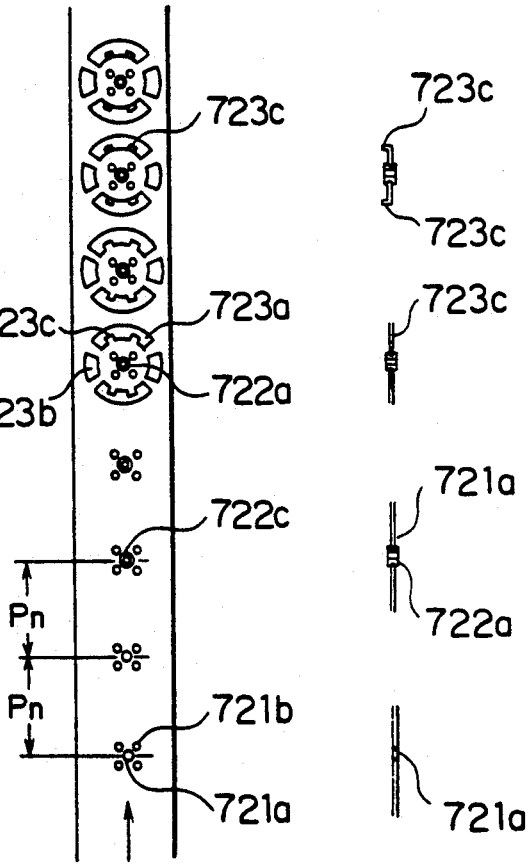
FIG. 49 is a plan view illustrating the state where the workpiece is machined.
FIG. 50 is a longitudinal section of the essential part of the workpiece at each stage in FIG. 49.

FIG. 48 is an enlarged plan view of the essential part of the first auxiliary machining line 702 in FIG. 41. FIG. 49 is a plan view illustrating the machining state of the workpiece 30*a*. FIG. 50 is a diagram illustrating the longitudinal sectional shape of the workpiece 30*a* at each stage in FIG. 48, shown in the same positional relationship with each other. Like parts are indicated by like numerals in FIG. 41. In FIGS. 48 and 49, $P_n$ is the indexing pitch of the workpiece 30*a*. The feeding device 720*a* and the punch-die sets 721–724 are disposed $2P_n$ on center. The pilot holes normally provided on the workpiece 30*a*, and the pilot guides are not shown in the figures, as in the case with the main machining line 701. In FIGS. 48 through 50, as the workpiece 30*a* is indexed at equal pitches of $P_n$ in the direction shown by an arrow, punching operation is performed at the machining position of the punch-die set 721 to form holes 721*a* and 721*b* on the workpiece 30*a*.

Next, a tubular member 722*a* formed on the workpiece 30*b* with the punch-die set 722, as will be described later, is inserted into a hole 721*a*. The tubular member 722*a* is then assembled and combined with the workpiece 30*a* by staking. Then, outward punching operation is performed with the punch-die set 723 to punch irregular-shaped holes 723*a* and 723*b* outside of the tubular member 722*a*, and thereby a projection 723*c* is formed. Then, hemming operation is performed with the punch-die set 724 to bend the edges of the projection 723*c* upwards to an angle of approximately 90 degrees. After that, the cap-shaped member 714*a* (refer to FIG. 47) formed on the workpiece 30 is combined with the composite member 717*a* with the punch-die set 717 comprising the main machining line 701.

Figure 54:
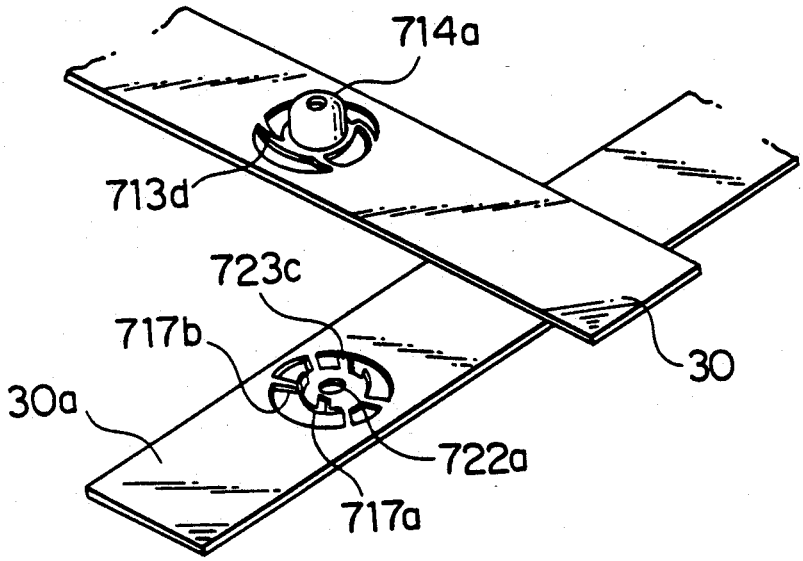
FIG. 54 is a perspective view of the essential part of the workpiece illustrating the state of the workpiece at the intersecting position.

FIG. 54 is a perspective view illustrating the state of the workpieces 30 and 30*a* at the intersecting point. Like parts are indicated by like numerals in FIGS. 45 and 50. In FIG. 54, the cap-shaped member 714*a* supported by the bridges 713*d* is formed on the workpiece 30, while the composite member 717*a* supported by the bridges 717*b* is formed on the workpiece 30*a*. In this state, as the punch-die 717 set shown in FIG. 45 is actuated, the workpieces 30 and 30*a* are combined together, the projection 723*c* is further bent inwards, and the bridges 717*b* supporting the composite member 717*a* are cut off. Thus, the cap-shaped member 714*a* and the composite member 717*a* are combined and assembled into one piece, as shown in FIG. 47.

Figure 51:
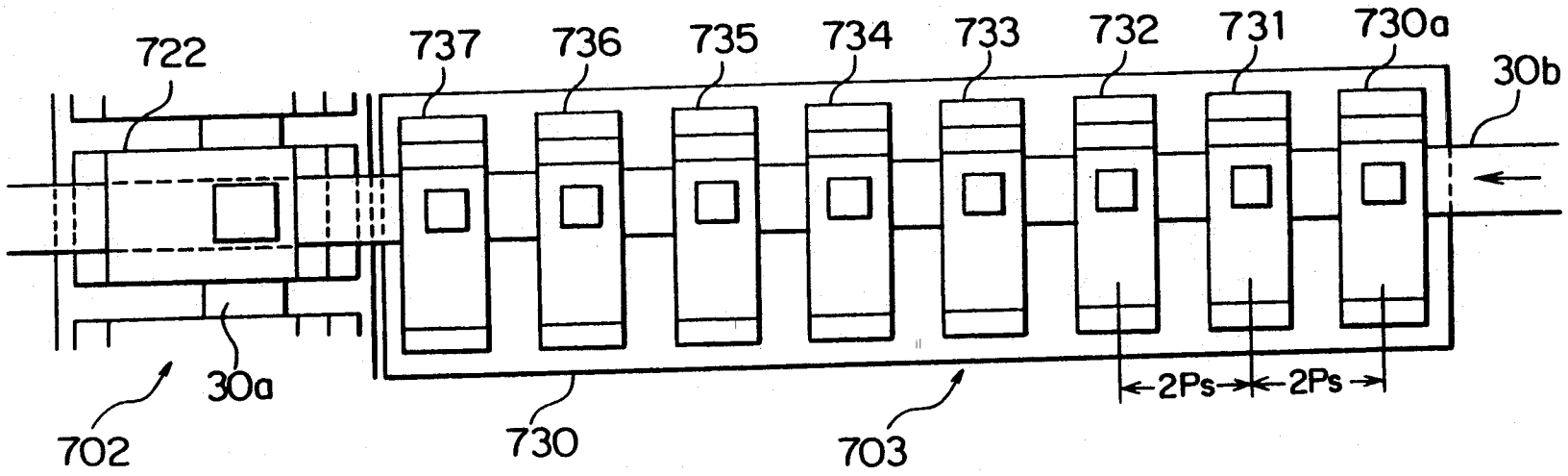
FIG. 51 is an enlarged plan view of the essential part of the second auxiliary machining line in FIG. 41.
Figure 52:
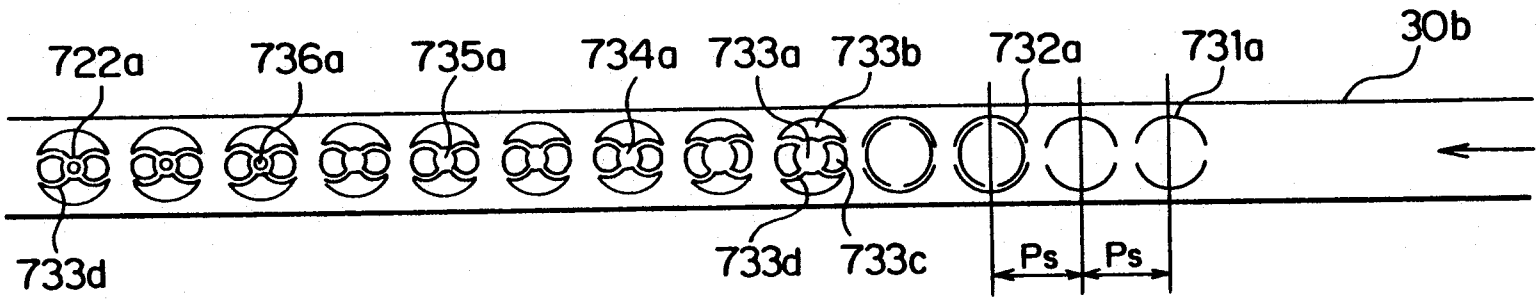
FIG. 52 is a plan view illustrating the state where the workpiece is machined.
Figure 53:
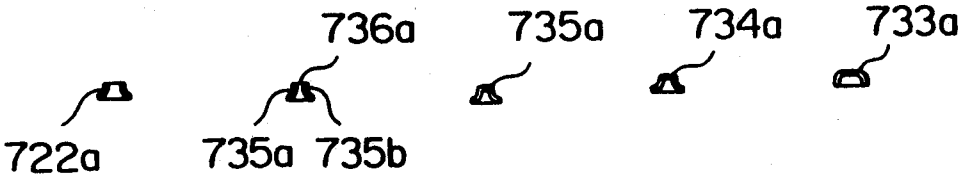
FIG. 53 is a longitudinal section of the workpiece at each stage in FIG. 52.
Figure 55:
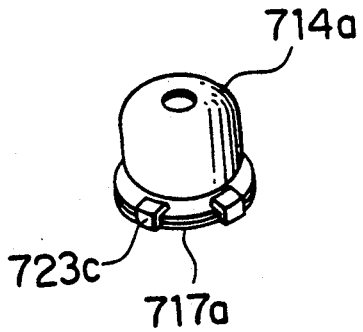
FIG. 55 is an enlarged perspective view illustrating a finished product.

FIG. 51 is a plan view illustrating the essential part of the second auxiliary machining line in FIG. 41. FIG. 52 is a plan view illustrating the machining state of the workpiece 30*b*. FIG. 53 is a diagram illustrating the longitudinal sectional shape of the essential part of the workpiece 30*b* at each stage in FIG. 51, shown in the same positional relationship with each other. Like parts are indicated by like numerals in FIG. 41. In FIGS. 51 and 52, symbol $P_s$ indicates an indexing pitch of the workpiece 30*b*, and the feeding device 730*a* and the punch-die sets 731–737 are disposed $2P_s$ on center. In these figures, too, the pilot holes provided on the workpiece 30*b* and the pilot guides, both used for positioning, are not shown, as in the case of the main machining line 701 and the first machining line 702. In FIGS. 51 through 53, the workpiece 30*b* is indexed by the feeding device 730*a* at equal pitches of $P_s$ in the direction shown by arrow, and each machining operation is performed with the punch-die sets 731–737. First, arc-shaped external lances 731*a* and arc-shaped internal lances 732*a* are machined on the workpiece 30*b* with the punch-die sets 731 and 732. The first drawing operation is then performed with the punch-die set 733 to form a cup-shaped projection 733*a* on the workpiece 30*b*, and the arc-shaped external and internal lances 731*a* and 732*a* are expanded into crescent-shaped grooves 733*b* and 733*c*. This results in the cup-shaped projection 733*c* supported by four arc-shaped bridges 733*d*. The second drawing operation is performed with the punch-die set 734 to form the cup-shaped projection 733*a* into a cap-shaped member 734*a* as shown in FIG. 53. Next, forming operation is performed with the punch-die set 735 to form the cap-shaped member 734*a* into a cap-shaped member 735*a* of a predetermined shape. A hole 736*a* is provided on the cap-shaped member 735*a* with the punch-die set 736. the external periphery 735*b* of the cap-shaped member 735*a* is trimmed with the punch-die set 737 to form a tubular member 722*a* having a predetermined outside diameter. As the workpiece 30*b* is then further indexed to the punch-die set 722 comprising the first auxiliary machining line 702, the tubular member 722*a* is inserted into a hole 721*a* formed on the workpiece 30*a*, as shown in FIG. 55 ad staked. The four bridges 733*d* (refer to FIG. 50) supporting the tubular member 722*a* are cut off. Thus, the tubular member 722*a* is combined and assembled into the workpiece 30*a*.

FIG. 55 is an enlarged perspective view illustrating a finished product manufactured with the embodiment of this invention, in which the composite member 717*a* and the cap-shaped member 714*a* are combined and assembled into one piece by bending the projection 723*c*.

In the index-feed machining described above, the workpieces 30*a* and 30*b* pass from the front side to the rear side through the punch-die sets 717 provided at the intersection of the main machining line 701 and the first auxiliary machining line 702, and the punch-die set 722 provided at the intersection of the first auxiliary machining line 702 and the second auxiliary machining line 703. Provision is therefore made to allow the workpieces 30*a* and 30*b* to smoothly pass providing passages 719 and 725, which pass through the holder members 717*a* and 722*a*, on the punch-die sets 717 and 722, as shown in FIGS. 43 and 44.

When the installation pitch of the punch-die sets 711–718 on the main machining line 701 in FIG. 41 is changed, or the position at which the main machining line 701 intersects with the first auxiliary machining line 702 is changed, the first auxiliary machining line 702 has to be moved for adjustment in parallel with the feeding direction of the workpiece 30 on the main machining line 701. In suh a case, the plate 720 may be moved for adjustment via the dovetail 720*b* and the dovetail groove 709*a* shown in FIG. 42 by loosening bolts and other fastening means (not shown) fastening the plate 720 and the base plate 709 (refer to FIG. 42). The relationship between the first auxiliary machining line 702 and the second auxiliary machining line 703 is the same as described above.

Although an example where the main machining line 701 is caused to orthogonally intersect with the first auxiliary machining line of one system has been described in this embodiment, a plurality of first auxiliary machining lines 702 may be caused to orthogonally intersect with the main machining line 701. Similarly, the same effects can be achieved by causing a plurality of second auxiliary machining lines 703 to orthogonally intersect with the first auxiliary machining line 702. When moving and adjusting these machining lines, the main machining line 701 may be formed so that the main machining line 701 can be moved and adjusted. In short, machining lines may be formed so that each of the machining lines can be moved with each other. The angle at which the lines intersect may be other than right angles. Furthermore, the above embodiments are concerned with an example in which the intervals of machining centers of a plurality of punch-die sets are set at twice the indexing pitch of the workpiece. This invention, however, is not limited to it, but may be other integral multiples, or the installation intervals of punch-die sets on the same machining line may differ from each other. Although the above embodiments show an example where the punch-die sets are disposed on the plate and then placed on the base plate, the punch-die sets may be disposed directly on the base plate instead of the use of the plate.

Although U-shaped punch-die sets have been described in the above embodiments, the shape of the punch-die sets may not be limited to the U shape, but may be of a gate type or any other types so long as punch-die sets are installed on upper and lower holder members that face each other at a certain interval.

In the above embodiments, description has been made on machining means which are limited to drawing and punching operations. This invention is not limited to them, but may be applied to index-feed machining using various machining means, including punching, bending, drawing, and compression. The above embodiments involve pilot portions of a round hole for positioning the workpiece. The pilot portions may be a square hole, or a hole of other shapes, or a groove, or a notch. The pilot portion may be of such as shape that part of the profile is opened to the edge part of the workpiece, or any other shape that can position the workpiece and prevent the dislocation of the workpiece during machining by engaging with guide rods disposed on the downstream side.

As described above, this invention, in which the pilot machining means and the pilot guide means are integrally constructed, makes it possible to offer an index-feed machining system that can improve the accuracy of machining positions during each machining operation even if there are some errors in the indexing feed of the workpiece, achieve high product yields with respect to the workpiece, and produce high-precision products. Since it is possible to easily and precisely position machining means, the accuracy of a machining position on the workpiece at each machining stage can be improved, and thereby still higher-precision products can be obtained. Furthermore, since it is made easy to change punches and dies, and other component members of machining means, multi-purpose index-feed machining is possible by replacing punches and dies with spot welders, measuring instruments, tapping devices, etc.

In addition to the effects expected from the index-feed machining system on which this invention is based, this invention makes it possible to improve means for disposing a plurality of independent machining means disposed on the base plate of the index-feed machining system, and improve workability in relation to the exchange, movement, etc. of machining means associated with changes in machining types, machining processes, machining sequence.

An index-feed machining system can be easily provided by using a press brake. The bottom dead point of moving parts in machining means can be easily adjusted.

Assembled products comprising a plurality of component members can be produced at high accuracy and high efficiency by not only subjecting individual component members to index-feed machining, but also automatically assembling individual component members into one unit at a position where machining lines intersect with each other.

What is claimed is:

1. An apparatus for machining a workpiece, the apparatus comprising:

means for indexing the workpiece at predetermined pitches;

pilot means for sequentially providing pilot portions on the workpiece;

pilot guide means integrally formed with said pilot means and for engaging with said pilot portions;

a base plate defining a dovetail groove in a feeding direction, said base plate also including a threaded shaft fixedly fitted to said base plate in a direction parallel with said dovetail groove;

a plurality of independent machining means for performing a corresponding plurality of machining processes being sequentially performed in accordance with said indexing of the workpiece and using said pilot portions as references, each of said plurality of machining means including a dovetail engaged with said dovetail of said base plate, said machining means being movably and positionably guided by said dovetail groove, said each of said plurality of machining means including a driving spiral gear rotatably fitted to said each of said plurality of machine means;

a plurality of driven spiral gears threadably engaged with said threaded shaft, one of each of said plurality of driven spiral gear meshing with one of said driving spiral gears, said plurality of machining means including connection means for independently moving said each of said plurality of machining means with said driven spiral gear as said each of said driven spiral gears move along said threaded shaft, said driven spiral gears moving along said threaded shaft by rotating about said threaded shaft, and said driving spiral gear rotating said driven spiral gear.

2. An apparatus as set forth in claim 1, wherein: one of said machining means is a press machine having a long ram; said machining means being installed on said base plate by such a means that said machining means can be moved and positioned while guided with said dovetail groove; and machining operations corresponding to said machining processes are sequentially performed by driving said press machine in accordance with the indexing feed of said workpiece and pushing moving parts of said machining means with the ram of said press machine.

3. An apparatus as set forth in claim 2 wherein a bottom dead point adjusting means for adjusting the bottom dead point of a moving part of each of said machining means is provide, said adjusting means protrudes at a position selected from the group consisting of a mounting position on the lower surface of said ram, and a mounting position on the upper surface of the moving part of each of said machining means, said adjusting means having a protruded length thereof being adapted to be adjustable.

4. An apparatus as set forth in claim 3 wherein said machining means comprise punch-die sets.

5. An apparatus as set forth in claim 1, further comprising: a main machining line is constructed by sequentially providing said plurality of machining means at intervals of $mP_m$ (m being a given positive integer, $P_m$ being an indexing pitch of a workpiece) in said feeding direction of the workpiece; one auxiliary machining line intersecting said main machining line and constructed by sequentially providing a plurality of auxiliary machining means at intervals of $nP_n$ (n being a given positive integer, $P_n$ being an indexing pitch of another workpiece) in a longitudinal feeding direction of another workpiece; and the apparatus for machining a workpiece is constructed as a multi-line apparatus by forming said auxiliary machining line in such a manner as to be movable and adjustable in parallel with the feeding direction of said main machining line, index-feed machining a plurality of component members, and assembling said component members at a position where said main machining line intersects with said auxiliary machining line.

6. An apparatus as set forth in claim 5, further comprising: another auxiliary machining line intersecting with one of said auxiliary machining means and constructed by sequentially providing a plurality of another auxiliary machining means at intervals of $sP_s$ (s being a given positive integer, $P_s$ being an indexing pitch of still another workpiece) in a feeding direction of still another strip-shaped workpiece; said one of said auxiliary machining means being constructed by forming said auxiliary machine line in such a manner as to be movable and adjustable in parallel with the feeding direction of said main machining line, index-feed machining a plurality of component members, and assembling said component members at a position where said machining line intersects with said auxiliary machining line, and at a position where said auxiliary machining lines intersects with each other.

7. An apparatus as set forth in claim 5 wherein: said plurality of machining means are provided in such a manner as to be movable and adjustable on a plate, said plate including on the bottom surface thereof a ridge extending in a direction intersecting with the feeding direction of the workpiece, said plate is placed on an auxiliary base plate on which a plurality of guide grooves are provided in a mutually intersecting manner in a matrix pattern, and said ridge is slidably engaged with one of said guide grooves so that said plate can be moved and adjusted.

8. An apparatus as set forth in claim 5 wherein a passage for permitting the workpiece to pass is provided by passing through one of said machining means provided at a position where machining lines intersect with each other.

9. An apparatus in accordance with claim 1, wherein:

said each of said machining means includes an independent driving means and pilot pins engaging with said pilot portions, said each of said machining means separately performing one of said machining processes on a unit of the workpiece, said machining processes being sequentially performed with said each of said machining means for each unit while pilot pins of said each of said machining means sequentially engage with corresponding pilot portions, said each of said machining means separately having corresponding said pilot pins engaging with the workpiece at separate times.

10. An apparatus for machining a workpiece, the apparatus comprising:

means for indexing the workpiece at predetermined pitches;

pilot means for sequentially providing pilot portions on the workpiece;

pilot guide means integrally formed with said pilot means and for engaging with said pilot portions;

a base plate defining a dovetail groove in a feeding direction, said base plate also including a threaded shaft fixedly fitted to said base plate in a direction parallel with said dovetail groove;

a plurality of independent machining means for performing a corresponding plurality of machining processes being sequentially performed in accordance with said indexing of the workpiece and using said pilot portions as references, each of said plurality of machining means including a dovetail engaged with said dovetail of said base plate, said machining means being movably and positionably guided by said dovetail groove, said each of said plurality of machining means including a rotatable driving spiral gear corresponding to said each of said plurality of machine means, each of said plurality of machine means including a female thread threadably engaged with said threaded shaft, each of said female threads being driven by one of said driving spiral gears, said each of said plurality of machining means including connection means connected to one of said driving spiral gears for independently moving said each of said plurality of machining means with said female thread as said each female thread moves along said threaded shaft, said female thread moving along said threaded shaft by relative rotation between said female thread and said threaded shaft, said driving spiral gear driving said female thread.

* * * * *